US010468743B2

(12) United States Patent
Huggins

(10) Patent No.: US 10,468,743 B2
(45) Date of Patent: Nov. 5, 2019

(54) MAST MOUNTABLE ANTENNA

(71) Applicant: United States of America as represented by the Federal Bureau of Investigation, Dept. of Justice, Washington, DC (US)

(72) Inventor: John Scott Huggins, Warrenton, VA (US)

(73) Assignee: United States of America as represented by the Federal Bureau of Investigation, Dept. of Justice, Washington, DC (US)

( * ) Notice: Subject to any disclaimer, the term of this patent is extended or adjusted under 35 U.S.C. 154(b) by 348 days.

(21) Appl. No.: 15/399,969

(22) Filed: Jan. 6, 2017

(65) Prior Publication Data

US 2017/0201002 A1 Jul. 13, 2017

Related U.S. Application Data

(60) Provisional application No. 62/275,934, filed on Jan. 7, 2016.

(51) Int. Cl.
*H01Q 1/12* (2006.01)
*H01Q 1/50* (2006.01)

(52) U.S. Cl.
CPC ..... *H01Q 1/1228* (2013.01)

(58) Field of Classification Search
CPC ..... H01Q 1/50; H01Q 1/1228; H01Q 9/32; H01Q 1/02
See application file for complete search history.

(56) References Cited

U.S. PATENT DOCUMENTS

| | | | |
|---|---|---|---|
| 2,124,424 | A | 7/1938 | Leeds |
| 2,184,771 | A | 12/1939 | Roosenstein |
| 2,201,857 | A | 5/1940 | Dome |
| 2,239,909 | A | 4/1941 | Buschbeck et al. |
| 2,297,512 | A | 9/1942 | Von Baeyer |
| 2,535,298 | A | 12/1950 | Lattin |
| 4,131,895 | A | 12/1978 | Robinson |
| 4,208,662 | A | 6/1980 | Horn et al. |
| 4,259,673 | A | 3/1981 | Guretzky |
| 4,282,531 | A | 8/1981 | Blaese |
| D260,522 | S | 9/1981 | Guretzky |
| 4,342,037 | A | 7/1982 | Dalby |

(Continued)

FOREIGN PATENT DOCUMENTS

DE 225204 8/1910

OTHER PUBLICATIONS

Griffith, A., "A 146- and 445-MHz J-Pole Antenna," QST Magazine, Oct. 2000, pp. 50-53.

(Continued)

*Primary Examiner* — Graham P Smith
*Assistant Examiner* — Jae K Kim
(74) *Attorney, Agent, or Firm* — Kristin K. Vidovich

(57) ABSTRACT

A mast mountable antenna that is rugged, weather-tolerant, and unaffected by the antenna's mounting structure, while maintaining an electrical path for lightning surge currents. The mast mountable antenna generally includes a radiating conductor section, an impedance transformer section, a low inductance feed point, a mounting mast section, a mast isolating stub section, and an integral coaxial feed line.

7 Claims, 20 Drawing Sheets

(56) References Cited

U.S. PATENT DOCUMENTS

| | | | | |
|---|---|---|---|---|
| 4,352,109 | A | 9/1982 | Reynolds et al. | |
| 4,441,108 | A | 4/1984 | Ten Pas | |
| 4,509,056 | A | 4/1985 | Ploussios | |
| 4,644,364 | A | 2/1987 | Parks | |
| 6,266,026 | B1 | 7/2001 | Stengel, Jr. | |
| 7,859,477 | B2 | 12/2010 | Birnbaum et al. | |
| 8,593,363 | B2 | 11/2013 | McLean et al. | |
| 8,947,313 | B2 | 2/2015 | Fong | |
| 2009/0102737 | A1* | 4/2009 | Birnbaum ..... | H01Q 9/30 343/828 |

OTHER PUBLICATIONS

Richardson, D., "The J-Pole Revisited," CQ Magazine, Mar. 1998, pp. 34, 35, 37-41.

U.S. War Department, "Antennas and Antenna Systems," War Department Technical Manual, TM 11-314, Nov. 1943, pp. 163-164.

Huggins, J., "Have your J-Pole and Ground It Too," Feb. 2015, http://www.hamradio.me/antennas/j-pole-antenna-grounding-have-your-j-pole-and-ground-it-too.html (pdf version of information on webpage submitted with IDS).

Duffy, O., Google Groups Comment, Jul. 17, 2010, https://groups.google.com/forum/#!msg/rec.radio.amateur. antenna/iHX5KmJ2Gdo/Gxx4aH-hp2gJ (pdf version of information on webpage submitted with IDS).

Pickard, G.W., "Experimenters Section Report—A Special Short-Wave Antenna," QST Magazine, Jun. 1925, pp. 52-53.

Ham.net Forum—http://www.eham.net/ehamforum/smf/index.php?topic=59659.0 (Jul. 2005) (accessed Dec. 28, 2016).

J.L. Harris, "A VHF-UHF 3-Band Mobile Antenna," QST, Feb. 1980, pp. 16-17.

* cited by examiner

MAST MOUNTABLE ANTENNA

CROSS-REFERENCE TO RELATED APPLICATIONS

This application is a non-provisional application claiming priority to U.S. Prov. Appl. No. 62/275,934, filed Jan. 7, 2016. The provisional application was filed on the same day, i.e., Jan. 7, 2016, as a related design application (U.S. patent application Ser. No. 29/550,780).

STATEMENT OF GOVERNMENT INTEREST

The invention described herein was invented by an employee of the United States Government and may be manufactured and used by or for the government for governmental purposes without the payment of any royalties.

BACKGROUND OF THE INVENTION

Field of the Invention

The field of the present invention relates generally to the technical field of antennas and, more specifically, it relates to mast mountable antennas that function as rugged, weather-tolerant, vertically polarized, outdoor antennas unaffected by the mounting structure while maintaining a low impedance electrical path for lightning surge currents.

Background

RF Currents Along Masts and Mounting Structures

Unintentional radio frequency currents flowing along, for example, the feed line, mast, and mounting structure, cause harm to the desired radiation pattern of an antenna assembly. A functional antenna design incorporates design features that allow radio frequency current to flow in such a way to maximize radiation of electromagnetic energy in the desired directions. A successful antenna design not only arranges conductors to provide the primary radiation mechanism, but includes design features to ensure the radio frequency current does not flow to other portions of the antenna system including, for example, the feed line, mast, and mounting structure.

Lightning Surge Management

In recent years, the susceptibility of radio communications facilities to induced and conducted lightning surge currents has increased as radio equipment manufacturers place more burden of protection on the facility buildings, infrastructure, and antenna systems.

The research to date indicates that every part of a communications system shall be designed to tolerate and handle the damaging currents from a near or direct lightning strike. Various industry standards and guidelines provide advice on infrastructure requirements including the proper use of robust bonding techniques for all the communications components via low inductance, high current capacity conductors all connected to earth grounds. The Motorola R56 document "Standards and Guidelines for Communication Sites," for example, is one publication specifying and teaching such techniques.

A properly designed antenna minimizes induction and conduction of radio frequency currents along, for example, antenna masts, antenna feed lines, and antenna mounting structures, while maximizing the conduction of lower frequency lightning surge currents from the antenna structure to the antenna mounting structure or grounding system. Moreover, a properly designed antenna prevents the accumulation of triboelectric charge on any part of the antenna assembly and directs any such charges to the mounting structure.

Previous Antenna Techniques

In 1909 in German Patent No. 225,204 ("Aerial Ladder Structure for Airships"), Beggerow illustrates the proto J antenna using link coupling as galvanic isolation of the aerial from the airship frame while passing radio frequency currents via the coupling's mutual inductance. Beggerow's system omits a mechanism to prevent the accumulation of triboelectric charge between the antenna conductor and the airship airframe.

In U.S. Pat. No. 2,124,424 ("Antenna System"), Leeds describes an antenna in the more familiar upright J antenna shape providing a continuous and robust conductor from top to bottom with no insulating sections, while facilitating half-wave aerial functionality at a radio operating frequency. Leeds discusses methods to mitigate unequal loading on the transmission line connection point to avert the flow of radio frequency current along the exterior of the feed line coaxial cable. Leeds omits discussion of the situation where the transmission line exterior conducting surface loads the feed point with an arbitrary impedance in parallel with the impedance presented by the antenna system depending only on the installation circumstances of the feed line.

The "J Antenna" described by the United States War Department in its 1943 technical manual number TM 11-314 (entitled "Antennas and Antenna Systems"), highlights the utility of using an attached conductive mast as a means to convey direct current and low frequency lightning surge currents to earth, but fails to recognize the necessity to isolate the mast at the antenna operating frequency.

In U.S. Pat. No. 4,208,662 ("Omnidirectional, Vertically Polarized Antenna"), Horn et al. show a method of mitigating coupling of energy from the radials by bending radial elements downward. Despite their efforts, the mechanical antenna element topology disregards the induction effects that, regardless of the antenna topology, excite currents in the supporting mast structure.

In U.S. Pat. No. 4,259,673 ("Stub Matched Antenna and Method of Feeding Same"), Guretzky outlines a method of coupling radio frequency energy from a feed line to a J antenna by wrapping the insulated center conductor of the feed line around the antenna element. Guretzky's technique lacks a means to provide a robust direct current short between the center and shield of said feed line to mitigate effects of lightning and triboelectric static charge.

In U.S. Pat. No. 4,282,531 ("Vertical Antenna with Upwardly Flaring Base Mounted Conductors"), Blaese shows a method of energizing an end fed dipole with a lower quarter-wave section made with three upward pointing conductors, but he lacks a means to mitigate the flow of radio frequency current on the antenna feed line and antenna supporting mast.

In U.S. Pat. No. 4,352,109 ("End Supportable Dipole Antenna"), Reynolds et al. introduce a secondary means to isolate the mast mounting structure, but fail to provide a direct current path for lightning currents to ground; and the methods described do not provide a robust direct current short between the center conductor and shield of the coaxial transmission line.

In the March 1998 article "The J-Pole Revisited," Richardson identifies and mitigates both the mast and feed line radio frequency currents with an inline mast insulator and feed line coil choke, respectively, resulting in a functional antenna immune to the radio frequency current flow induced by the impedances presented in parallel to the antenna impedance by the mast and feed line. The approach does not, however, provide a robust direct current path for lightning surge currents.

In the October 2000 article "A 146- and 445-MHz J-Pole Antenna," Griffith teaches a modification to the traditional J antenna design whereby the traditional feed point on the lower "J" stub is removed leaving the stub to, allegedly, perform the role of a mast decoupling stub. The feed point is moved to a split upper half-wave element, comprising a vertical center-fed dipole, and fed at the split with a feed line internal to the hollow antenna structure. Other design amendments facilitate additional operation at, approximately, the third harmonic of the primary frequency. While introducing new functionality to the basic J antenna design, it neglects to provide a robust direct current short between the feed line center conductor and shield, and fails to provide a robust direct current path for lightning surge currents from the top of the antenna to the earth. Additionally the alleged use of the lower traditional J element as a mast decoupling stub fails in view of the fact that the J stub's position with respect to the upper vertical dipole provides no radio frequency current choking action and instead transforms the high impedance bottom end of the above vertical dipole to a low impedance at the bottom of the J stub, thereby allowing radio frequency currents to propagate through the J section and to the conductive mast below.

In a July 2005 forum post on www.eham.net titled "Decoupling Radials on Elevated Verticals," Hunt states that one-quarter wavelength radials are placed one-quarter wavelength below the point where one would want to block the flow of RF current, recognizing that at the point where the one-quarter wave radials intersect with the mast, the impedance is a relatively low value. This relatively low impedance is transformed via the inline conductive mast to relatively high impedance one-quarter wavelength above or one-quarter wavelength below the connection point. He describes the usage of these mast decoupling radials one-quarter wavelength below the radials of a traditional vertical antenna while focusing on the fact that each set of radials performs a distinctly separate function in the overall antenna and antenna mast design. Hunt continues with a discussion of the possible interactions between the two sets of radials and how interaction is mitigated by antenna designers using differing numbers of radials for each set. This explanation does not address the concept of orienting a single lower radial upward and parallel to the mast to accomplish the same mast decoupling role without protruding into horizontal space away from the mast.

In U.S. Pat. No. 7,859,477 ("J-Pole Antenna"), Birnbaum et al. reveal a way to connect a J antenna directly to a coaxial connector, but fail to provide a means to mitigate the flow of currents along the outside of the implied transmission line connected to the coaxial connector.

In U.S. Pat. No. 8,947,313 ("Radial-Free Collinear Omni-Directional Antenna with Gain and Virtual Ground"), Fong describes a means to make a collinear antenna using the basic J antenna as a fundamental building block, but provides no means to mitigate radio currents on a conductive mounting mast and feed line.

In U.S. Pat. No. 8,593,363 ("End-Fed Sleeve Dipole Antenna Comprising a 3/4-Wave Transformer"), McLean et al. provide a method to mitigate the conduction of radio frequency currents along the mast mounting structure. However, the antenna design lacks a means to provide a direct current short from the uppermost radiating element to the mounting mast to properly manage lightning surge currents.

In a July 2010 post to www.rec.radio.amateur.antenna, Duffy describes a method of dressing the feed line externally to yield an integral radio frequency choke action. However, he lacks a means to provide a method to place the feed line within the hollow pipe structure to protect the feed line from the elements.

BRIEF SUMMARY OF THE INVENTION

There is a need for antennas at elevated locations that can maintain a tolerance for lightning. More specifically, there is a need for antennas that not only tolerate, but direct the surge currents from a direct or nearby lightning strike to the earth, while maintaining communications performance from an elevated location for a desired frequency of operation.

To meet this need, the present invention is directed to products and methods for coupling a radio frequency from a radio system to the environment via a mast mountable antenna that provides this coupling mechanism, while maintaining a direct and robust conductive path for the direct or induced electric currents caused by direct or nearby lightning strikes or dissipation of triboelectric static charge.

Thus, one object of the invention is to provide a rugged, weather tolerant, mast mountable antenna that is unaffected by the antenna's mounting structure while maintaining a low impedance electrical path for lightning surge currents.

Another object is to provide a mast mountable antenna that preserves the radiation pattern of the active antenna element in the presence of the antenna mounting structure, regardless of the type of mounting structure.

Another object is to provide a mast mountable antenna that eliminates the need for the vulnerable, exposed external feed line associated with J antennas.

Another object is to provide a mast mountable antenna that mitigates the inductance of the traditional J antenna feed point.

Another object is to provide a mast mountable antenna that suppresses the conduction of radio frequency currents to the antenna mounting structure, regardless of the type of mounting structure.

Another object is to provide a mast mountable antenna that suppresses the induction of radio frequency currents to the antenna mounting structure, regardless of the type of mounting structure.

Another object is to provide a mast mountable antenna that provides an electrical direct current short between the antenna feed points.

Another object is to provide a mast mountable antenna that provides an electrical direct current short between at least one of the antenna feed points and the antenna mounting structure, regardless of the type of mounting structure.

Another object is to provide a mast mountable antenna that provides an electrical direct current short from every portion of the antenna to the antenna mounting structure, regardless of the type of mounting structure.

Another object is to provide a mast mountable antenna that provides a feed point connection below and away from the radiating portion of the antenna.

Another object is to provide a mast mountable antenna that suppresses the conduction of radio frequency currents along the feed line.

Another object is to provide a mast mountable antenna that suppresses the induction of radio frequency currents along the feed line.

Another object is to provide a mast mountable antenna that eliminates the need for the use of insulating materials in load-bearing antenna components.

Another object is to provide a mast mountable antenna that maintains the slender nature of the traditional J antenna, while mitigating issues with induced currents.

Another object is to provide a mast mountable antenna that conducts lightning surge energy on any part of the antenna to the antenna mounting structure, regardless of the type of mounting structure.

Another object is to provide a mast mountable antenna that facilitates a preferential path of lightning energy through the mounting structure (regardless of the type of mounting structure) and a less preferential path of lightning energy through the feed line.

Another object is to provide a mast mountable antenna that functions in the presence of conductive paints and other types of antenna treatments.

Another object is to provide a mast mountable antenna that is made entirely of conductive materials.

Another object is to provide a mast mountable antenna that provides a discharge path for accumulated static charge.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form part of the specification, illustrate embodiments of the present invention and, together with the description, further serve to explain the principles of the invention and to enable a person skilled in the relevant art(s) to make and use the invention.

FIG. 1 is an upper perspective view of an embodiment of the present invention.

FIG. 2 is a front view of an embodiment of the present invention.

FIG. 3 is a left side view of an embodiment of the present invention.

FIG. 4 is a right side view of an embodiment of the present invention.

FIG. 5 is an offset-section view of an embodiment of the present invention taken along line 5-5 of FIG. 3 illustrating the low inductance feed point (40) and internal feed line (73). The second feed point cylinder conductor (42) is connected to the transition conductor (43) that goes inside an opening (44) in the first feed point cylinder conductor (41). The internal feed line (73) is internal to the antenna tubing and emerges at a low inductance feed point gap (45) to energize the antenna as in a traditional J antenna. The diameter of the feed point cylinders (41)(42) in series with the conductors of the T connections (the first and second feed tap tees (26)(27)) lowers the series inductance between the feed point gap (45) and the two quarter-wave conductors (21)(22)(31)(32). The internal feed line (73) continues through the lower portion of the hollow tee (26), an onward through hollow tube, which is the quarter-wave transformer inline member (32), hollow impedance transformer bottom tee (25), hollow tube, which is the mounting mast top (54), toward the antenna system feed junction below (not shown in this figure). The preferably hollow conductive pipes serve a dual purpose on the right side of the drawing in FIG. 5 by acting as antenna components on the outside and convenient transmission lines on the inside.

FIG. 6 is a offset-section view of an embodiment of the present invention taken along line 6-6 in FIG. 4 illustrating the internal feed line (73) passing through the hollow upper mounting mast member (51), the hollow mast decoupling stub tee (64), and the hollow lower mounting mast member (52).

FIG. 7 is a top view of an embodiment of the present invention.

FIG. 8 is a bottom view of an embodiment of the present invention.

FIG. 9 is a cross-section view of an embodiment of the present invention taken in the direction of line 9-9 of FIG. 2. The cross-section view reveals the connection of an internal feed line (73) integral to the body of the mast mountable vertical antenna to the low inductance second feed point cylinder conductor (42) via a transition conductor (43).

FIG. 10 is a cross-section view of an embodiment of the present invention taken in the direction of line 10-10 in FIG. 2. The cross-section of the bottom tube, which is the lower mounting mast member (52), reveals a coaxial internal feed line (73) and an outer conductor (74) integral to the body of the vertical mast mountable antenna.

FIG. 11 is an upper perspective view of a basic, untreated, unfixed J antenna (100). The view includes the indication of antenna electrical current standing wave magnitudes (200). The traditional J antenna shown in this figure is comprised of a half-wave radiating element wire (101), inline portion of a quarter-wave parallel transformer conductor (102), such as a wire, a cross bar wire (104), and a side quarter-wave parallel transformer conductor (103), such as a wire. A short mounting stub wire (105) connects to the junction between the quarter-wave parallel transformer conductor (102) and the cross bar wire (104). When energized, the half-wave radiating element wire (101) has a half-wave current shown with position magnitude (202). The quarter-wave parallel transformer conductors (102)(103) have currents shown with positional magnitudes (204)(205), respectively.

FIG. 12 is an upper perspective view of the J antenna in FIG. 11 (100) above a simulated ground (106) of infinite extent and of moderate conductivity and dielectric value.

FIG. 13 is an upper perspective view of the J antenna in FIG. 11 (100) above the simulated ground (106) of FIG. 12 with a conductive mast (107) replacing the mounting stub wire (105). The J antenna (100) of FIG. 11 above the simulated ground (106) of FIG. 12 with the addition of a conductive mast (107) between the J antenna (100) and the simulated ground (106) cause the mast (107) to become part of the antenna (100) with the standing wave current magnitudes (207)(209)(211)(213) flowing to the simulated ground (106). The mast (107) electrically connects to the ground at its base (108). The current magnitude at the base of the mast (107) is of maximum amplitude (215). This drawing of an alternative wire embodiment of the traditional J antenna atop an electrically conductive mast illustrates one of the problems that the present invention (as shown in the embodiment of FIG. 1) addresses.

FIG. 14 is a perspective view of the assembly shown in FIG. 13 with the addition of a perpendicular quarter-wave radial (109) mounted a quarter-wave below the J antenna (100). The radial (109) presents a high impedance point just beneath the J antenna (100) effectively impeding current from flowing down the mast (107). The current magnitude peaks (220)(222)(224) are reduced due to the existence of the perpendicular radial (109).

FIG. 15 is a perspective view of the assembly shown in FIG. 13 with the addition of a mast decoupling stub component comprised of a parallel quarter-wave conductor stub (110) mounted a quarter-wave below the J antenna (100) with a shorting bar (111) connecting the stub to the mast (107). The parallel quarter-wave conductor stub (110) presents a high impedance point just beneath the J antenna (100) effectively impeding current from flowing down the mast (107). The current magnitude peaks (230)(232)(234) are reduced due to the existence of the parallel quarter-wave conductor stub (110).

FIG. 16 is a simulated elevation cut of the far-field gain (in dBi) pattern (in degrees) of the J antenna structure (100) in FIG. 11 above the simulated ground (106) in FIG. 12. This is not a representation of isotropic free space gain, but the gain with the J antenna structure (100) a certain distance above the simulated ground (106). The point −90 degrees in the graph corresponds to the direction of the J antenna structure's (100) quarter-wave parallel side conductor (103), as shown in FIG. 11, whereas the point 90 degrees in the graph corresponds to the direction opposite the J antenna structure's (100) quarter-wave parallel side conductor (103). The point of maximum gain (301) is approximately 6 dBi at an angle of approximately −84 degrees or 6 degrees above the horizon in the direction of the quarter-wave parallel transformer side conductor (103). The next highest point of maximum gain (302) is approximately 5.6 dBi at an angle of approximately 84 degrees or 6 degrees above the horizon in the direction away from the quarter-wave parallel transformer side conductor (103).

FIG. 17 is a simulated elevation cut of the far-field gain (in dBi) pattern (in degrees) of the J antenna structure (100) above ground with the conductive elongated mounting mast (107) between the J antenna structure (100) and the simulated ground (106) in FIG. 13. This is not a representation of isotropic free space gain, but the gain with the J antenna structure (100) a certain distance above the simulated ground (106). The point −90 degrees in the graph corresponds to the direction of the J antenna structure's (100) quarter-wave parallel side conductor (103), as shown in FIG. 11, for example, whereas the point 90 degrees in the graph corresponds to the direction opposite the J antenna structure's (100) quarter-wave parallel side conductor (103). The point of maximum gain (306) is approximately 6.5 dBi at an angle of approximately 21 degrees or 69 degrees above the horizon in the direction away from the quarter-wave parallel transformer side conductor (103). The next point of maximum gain (305) is approximately 4.5 dBi at an angle of approximately −20 degrees or 70 degrees above the horizon in the direction of the quarter-wave parallel transformer side conductor (103). The gain near the horizon in the direction of the parallel transformer side conductor (103) is approximately 3 dBi at an angle of approximately 6 degrees above the horizon (303). The gain near the horizon in the direction away from the parallel transformer side conductor (103) is approximately −1 dBi at an angle of approximately 6 degrees above the horizon (304). The mast currents (207)(209)(211)(213)(215) perturb the pattern of the J antenna structure (100) raising the strongest lobes (305)(306) well above the horizon.

FIG. 18 is a simulated elevation cut of the far-field gain (in dBi) pattern (in degrees) of the J antenna (100) above ground with mast (107) between J antenna (100) and the simulated ground (106) and the perpendicular radial (109) in FIG. 14. This is not a representation of isotropic free space gain, but the gain with the J antenna (100) a certain distance above the simulated ground (106) in FIG. 14. The point −90 degrees in the graph corresponds to the direction of the J antenna's (100) quarter-wave parallel transformer side conductor (103), as shown in FIG. 11, for example, whereas the point 90 degrees in the graph corresponds to the direction opposite the J antenna's (100) quarter-wave transformer parallel side conductor (103). The point of maximum gain (307) is approximately 5 dBi at an angle of approximately −84 degrees or 6 degrees above the horizon in the direction of the quarter-wave parallel transformer side conductor (103). The next point of maximum gain (308) is approximately 4 dBi at an angle of approximately 84 degrees or 6 degrees above the horizon in the direction away from the quarter-wave parallel transformer side conductor (103). This graph suggests the perpendicular radial (109) of FIG. 14 partially mitigates the mast currents reducing their effect on the overall far-field pattern.

FIG. 19 is a simulated elevation cut of the far-field gain (in dBi) pattern (in degrees) of the present invention above ground with mast (107) between the J antenna (100) and the simulated ground (106) and the parallel mast decoupling stub component (110)(111) in FIG. 15. This is not a representation of isotropic free space gain, but the gain with the J antenna (100) a certain distance above the simulated ground (106) in FIG. 15. The point −90 degrees in the graph corresponds to the direction of the J antenna's (100) quarter-wave parallel transformer side conductor (103), as shown in FIG. 11, for example, whereas the point 90 degrees in the graph corresponds to the direction opposite the J antenna's (100) quarter-wave parallel transformer side conductor (103). The point of maximum gain (309) is approximately 6 dBi at an angle of approximately −84 degrees or 6 degrees above the horizon in the direction of the quarter-wave parallel transformer side conductor (103). The next point of maximum gain (310) is approximately 4.6 dBi at an angle of approximately 84 degrees or 6 degrees above the horizon in the direction away from the quarter-wave parallel transformer side conductor (103). This graph reveals that the parallel mast decoupling stub component (110)(111) of FIG. 15 negates the mast currents eliminating their effect on the overall far-field pattern.

FIGS. 20A and 20B detail the design of an approximately 1 GHz J antenna (401)(402)(403)(404) with feed point (405) above a collinear mounting mast (408) with free hanging end (409). Two versions of the J antenna are shown: FIG. 20A shows the traditional J antenna with mast; and FIG. 20B shows the traditional J antenna with mast shown in FIG. 20A together with a mast decoupling stub (406)(407). The length dimension (410) denotes the variable length of the mast (408) varied for measurements.

FIGS. 21A and 21B graph the measurement of return loss (S11) vs. frequency (GHz) of the approximately 1 GHz antennas of FIGS. 20A and 20B. FIG. 21A shows the return loss of the J antenna of FIG. 20A. FIG. 21B shows the return loss of the J antenna with mast decoupling stub of FIG. 20B. The graphs superimpose one plot for each distinct length of mast.

FIGS. 22A and 22B graph the measurement of voltage standing wave ratio (VSWR) vs. frequency (GHz) of the approximately 1 GHz antennas of FIGS. 20A and 20B. FIG. 22A shows the VSWR of the J antenna of FIG. 20A. FIG. 22B shows the VSWR of the J antenna with mast decoupling stub of FIG. 20B. The graphs superimpose one plot for each distinct length of mast.

FIGS. 23A and 23B graph the measurement of antenna gain in the E-plane along the plane through the main body and stubs of the 1 GHz antennas of FIGS. 20A and 20B. FIG. 23A shows the gain vs. elevation angle of the J antenna of FIG. 20A. FIG. 23B shows the gain vs. elevation angle of the J antenna with mast decoupling stub of FIG. 20B. The graphs superimpose one plot for each distinct length of mast.

FIG. 24 is a flow chart describing a process to create a mast mountable antenna.

FIG. 25 is a flow chart describing a process to create a mast mountable antenna with an integral feed line.

Figure 1:
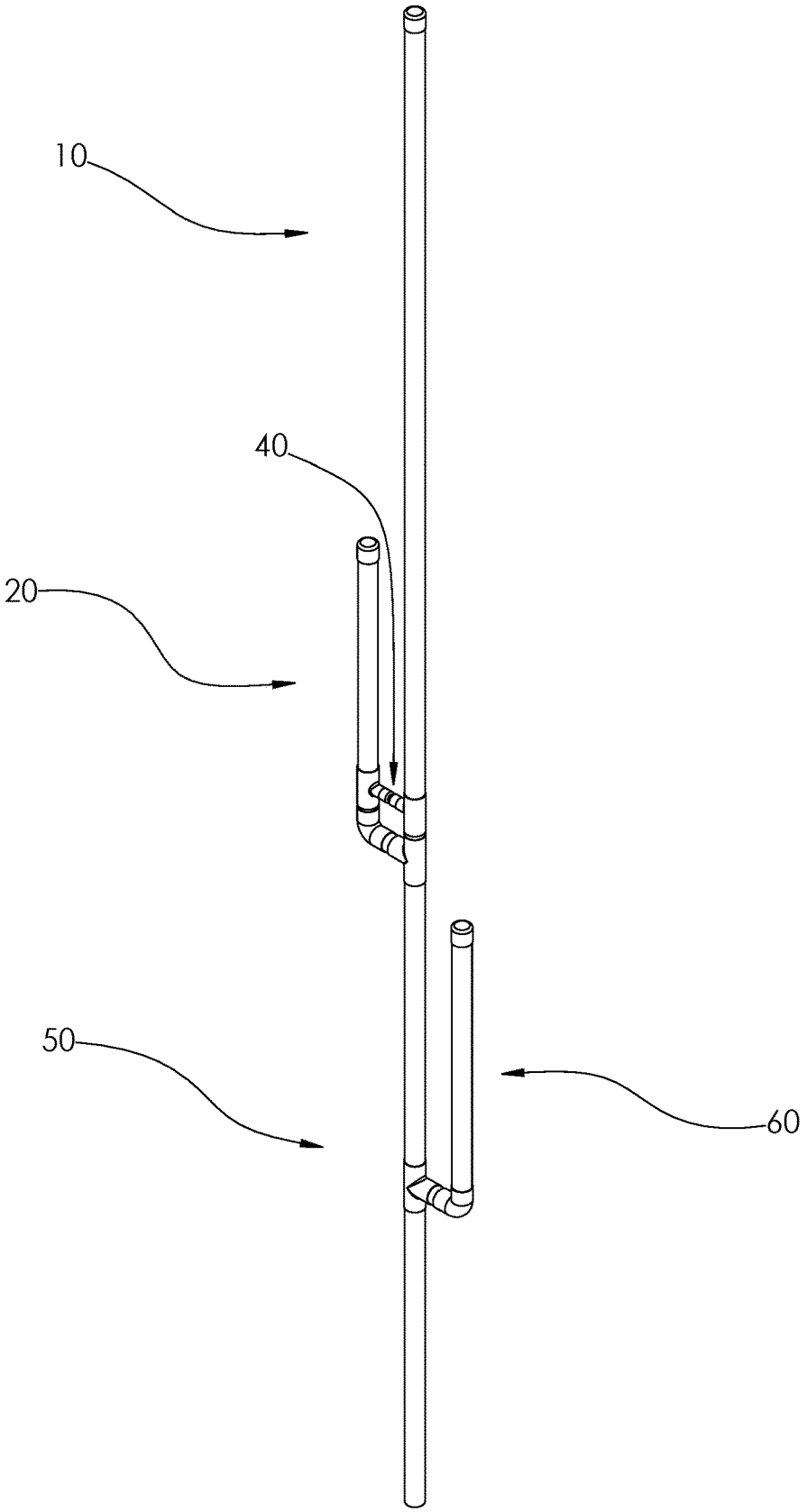
FIG. 1.

The features and advantages of the present invention will become more apparent from the detailed description set forth below when taken in conjunction with the drawings, in which like reference characters identify corresponding elements and sections. In the drawings, like reference numbers generally indicate identical, functionally similar, and/or structurally similar elements and sections.

DETAILED DESCRIPTION OF THE INVENTION

The specification discloses embodiments that incorporate features of the invention. The disclosed embodiments merely exemplify the invention and the scope of the invention is not limited to the disclosed embodiments. The invention is defined by the claims appended hereto.

The description of the embodiments of the invention, and references in the specification to "one embodiment," "an embodiment," "preferred embodiments," "alternative embodiments," "example," etc., indicate that the embodiments may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the relevant art(s) to link such feature, structure, or characteristic in connection with other embodiments whether or not explicitly described.

Overview

Preferred embodiments of the J antenna of the present invention contain antenna sections, namely: a radiating conductor section (also called a half-wavelength radiator, half-wave radiator, dipole, end fed dipole, dipole antenna, inline collinear array, or end fed dipole antenna) (10); an impedance transformer section (also called a quarter-wavelength transformer, quarter-wave transformer, parallel transmission line, parallel stub, transformer section, or variations thereof) (20); a low inductance feed point (40); a mounting mast section (50); a mast isolating stub section (also called a quarter-wave mast decoupling stub section) (60); and an integral coaxial feed line (73)(74). The internal feed line (73) is also called a transmission line, center conductor, internal feed conductor, feed line inner conductor, coaxial feed line inner conductor, or internal tubular conductor. The outer or external feed line (74) is also called an outer or external conductor or outer or external conductor tube.

Radiating Conductor Section

The radiating conductor section (10) is preferably the primary radiating conductor in the antenna assembly (also called antenna structure) of the present invention. It has an electrical length of, for example, at least one-half wavelength at the desired operating frequency. In terms of open space, it is preferably clear of all other elements and sections of the antenna structure. One end (11) of the radiating conductor section (10) is open (or free), while the other end (13) is affixed and connects to one of the inline conductors (22) at a point (29) on the impedance transformer section (20). This radiating conductor section (10) is made from, preferably, a hollow conductor.

A linear conductor of approximately one half-wavelength long at the desired operating radio frequency is the fundamental element of most antenna designs. A half-wave radiating conductor section (10) (as shown in FIG. 1) has characteristics of a stand-alone one-half wavelength conductor with a free end (11), a midpoint (12), and an affixed end (13). Often energy is supplied to half-wave antennas at their midpoint (12) where lower voltage and higher current conditions facilitate a low impedance feed point compatible with coaxial feed lines. Such antennas have varying methods to dress the feed line away from the half-wavelength conductor, but the result compromises the radiation pattern of the antenna. End-feeding the half-wavelength conductor eliminates this problem. Thus, in the present invention, the antenna is preferably fed at the affixed end (13) of the half-wave radiating conductor section (10), which results in an end-fed half-wave radiating conductor section. The affixed end (13) has a higher voltage and lower current resulting in a feed point impedance much higher than the commonly used coaxial feed lines. The half-wave radiating conductor section (10) connects with the impedance transformer section (20) at the half-wave radiating conductor section's affixed end (13).

The half-wave radiating conductor section (10) may be formed from any linear conductor, including, but not limited to, self-supporting metallic pipe or tubing. Flexible wire may also be used, provided that there is a method to keep the wire straight. Methods used to keep conductor wires straight include, but are not limited to, maintaining tension on the wire via non-conductive end supports, placing the wire within a non-conductive, non-flexible housing such as plastic pipe, and printing the conductor onto a non-conductive flat surface such as printed circuit board (PCB) materials.

Impedance Transformer Section

The impedance transformer section (20) between the radiating conductor section (10) and the mounting mast section (50) transforms the high impedance affixed end (13) of the radiating conductor section (10) to a lower impedance compatible with the feed line impedance. The impedance transformer section (20) is formed by two parallel conductors (21)(31) and (22)(32) each with length of, for example, one-quarter wavelength, with a shorting bar (23) at the bottom ends. The shorter end of the inline conductor (32) connects to the mounting mast top (54) through conductive tee (25), while the other end of the inline conductor (22) connects to one end of the radiating conductor section (10) at their common high voltage, low current point (29). The impedance transformer section (20) is made from, preferably, a hollow conductor.

The impedance transformer section (20) creates a parallel conductor transmission line transformer (or parallel transformer) with high voltage, low current (high impedance) at the top ends (28)(29) and low impedance at the shorting bar end (23). When one quarter-wave in length, the impedance transformer section (20) may be thought of as a half-wavelength conductor bent into the shape of the letter "U" starting at the open top end (28) to the bottom of the "U" at the shorting bar (23) and ending at the high voltage point top end (29). Because this is essentially a half-wavelength antenna bent into the shape of a "U," a feed point may be attached anywhere along the two parallel conductors (21)(22)(31)(32) to obtain an impedance value between the high current, low voltage point at the shorting bar (23) and the high voltage, low current points at the ends (28)(29). Generally, in practice, it is preferable to match to a low impedance transmission line, thus one embodiment of the invention has feed point connections just above the bottom of the "U" at the shorting bar (23) at the points of the feed tap tees (26)(27) about 10% above the shorting bar (23). Thus configured, the parallel transformer becomes an impedance transformer section (20) between the feed tap tees (26)(27) and the high impedance connection end point (29) to the radiating conductor section (10).

Energy entering the feed tap tees (26)(27) is transformed to a high impedance at the tops of the "U" shape (28)(29). The top of one side of the "U" shape (29) directly connects to the bottom high impedance point (13) of the radiating conductor section (10). As is known in the art, maximal power flows across two points when their impedances are similar. Since the impedance transformer section (20) and radiating conductor section (10) connect at their respective high impedance points (13)(29), power flows from the feed tap tees (26)(27) to the radiating conductor section (10).

Any assembly that maintains two parallel electrical conductors and is approximately one quarter-wavelength, or one quarter-wavelength plus one or more half-wavelengths, long will perform the role of an impedance transformer. The governing characteristics of the transformer depend on the characteristic surge impedance of the parallel conductors. In one embodiment of the invention, self-supporting conductive pipe is used to maintain the dimensions of the two parallel conductors (21)(22) and the distance between them. Ladder line also makes an excellent transformer. The parallel conductors may have the same or different diameters.

Low Inductance Feed Point

Figure 5:
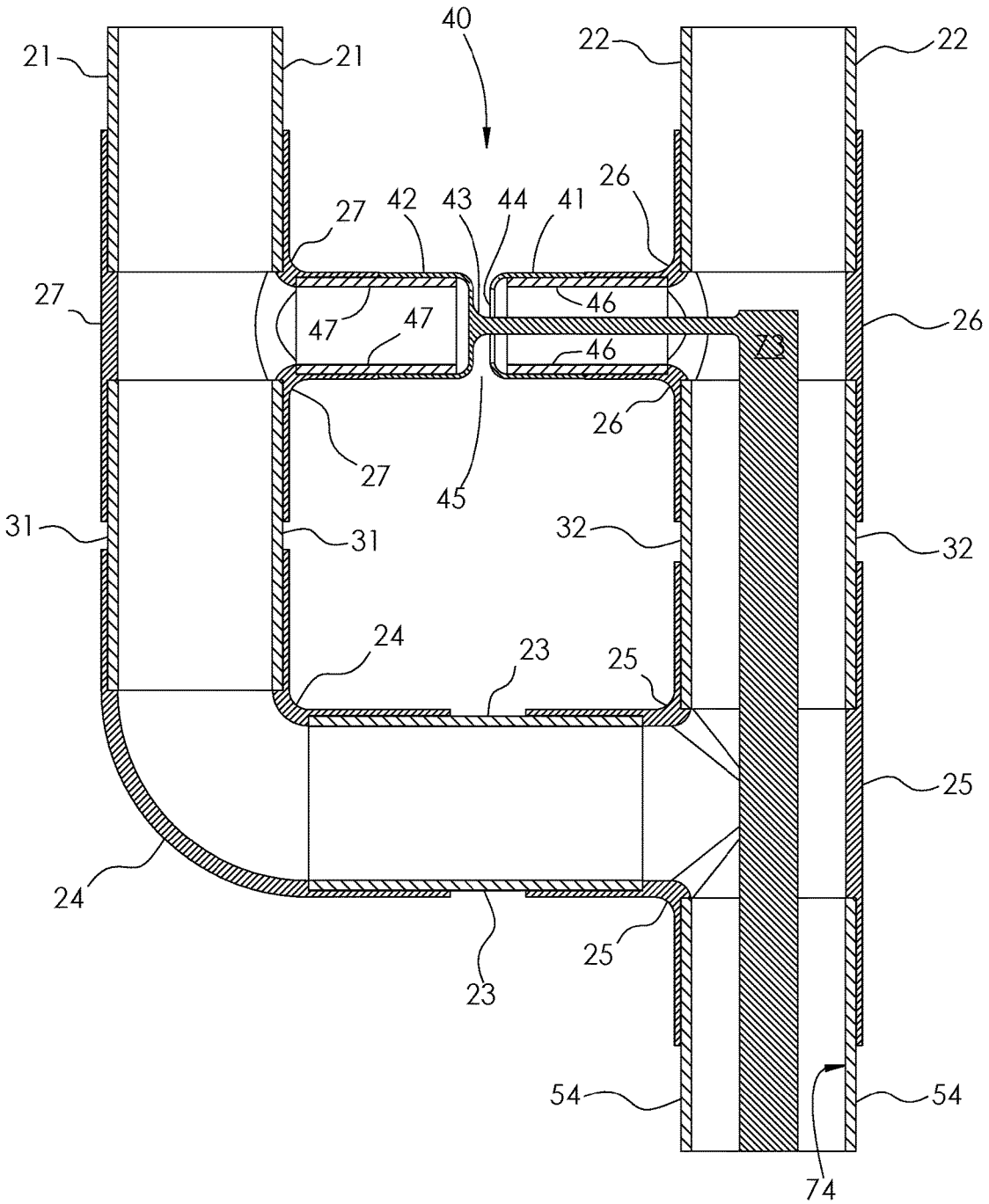
FIG. 5.

The low inductance feed point (40) (as shown in FIGS. 1 and 5), is within and close to the closed, low impedance, end of the impedance transformer section (20). This section comprises two thick protrusions (41)(42) directed inward toward each other. Being thicker than wire conductors, the protrusions reduce the inductance between the feed point (40) and the two points along the impedance transformer section (20), i.e., the first and second feed tap tees (26)(27). The two protrusions (41)(42) are made from, preferably, a hollow conductor.

The traditional J antenna flays out the transmission line to two relatively thin conductors that then connect to each side of the parallel tubes in the J-shaped impedance transformer section. Thin conductors are more inductive than thick conductors. This inductance combines with the natural feed impedance present on the antenna. The use of thicker conductors reduces the inductance, and reduces the feed gap distance hence leaving the feed point a narrow section suitable for direct connection to the feed line without the need to flay the ends. This is true with both an externally connected and internally routed feed line.

One of the two typical ways to feed a J antenna is described in, for example, U.S. Pat. No. 2,124,424, wherein for the typical feed, the conductors of the feed line must diverge and travel the distance to the feed point locations along the impedance transformer. This results in thin, relatively high inductance conductors connecting the transmission line to the antenna. This series inductance adds to the impedance of the antenna feed point making a proper impedance match to practical transmission line more difficult.

Figure 7:
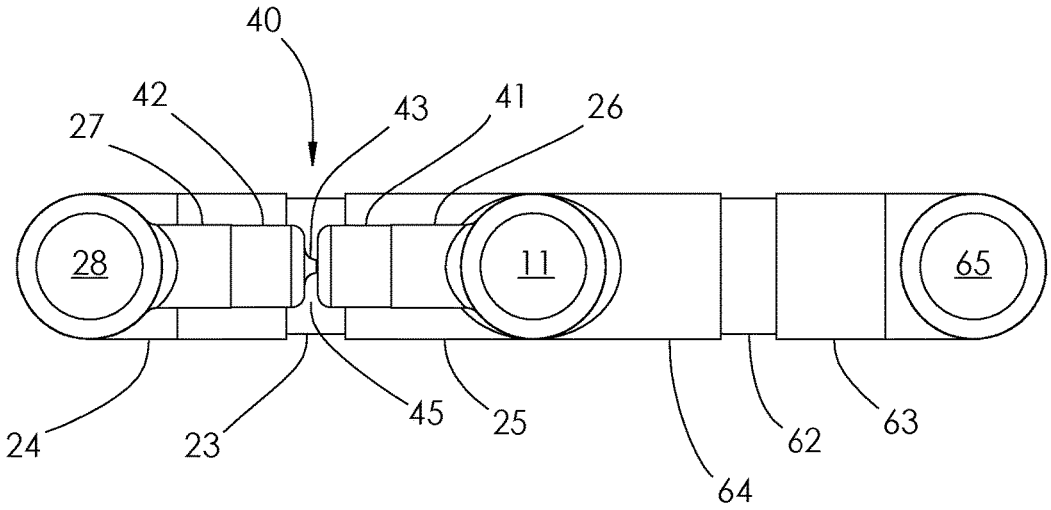
FIG. 7.
Figure 8:
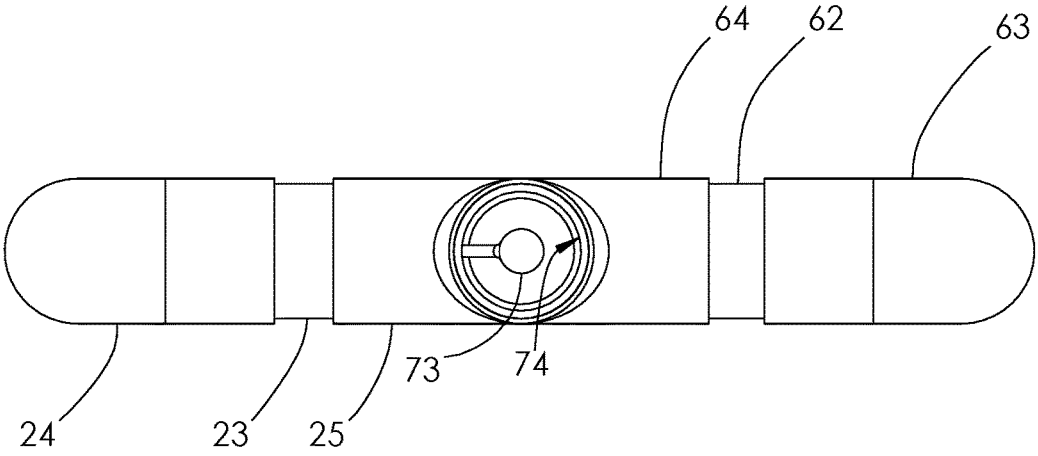
FIG. 8.
Figure 9:
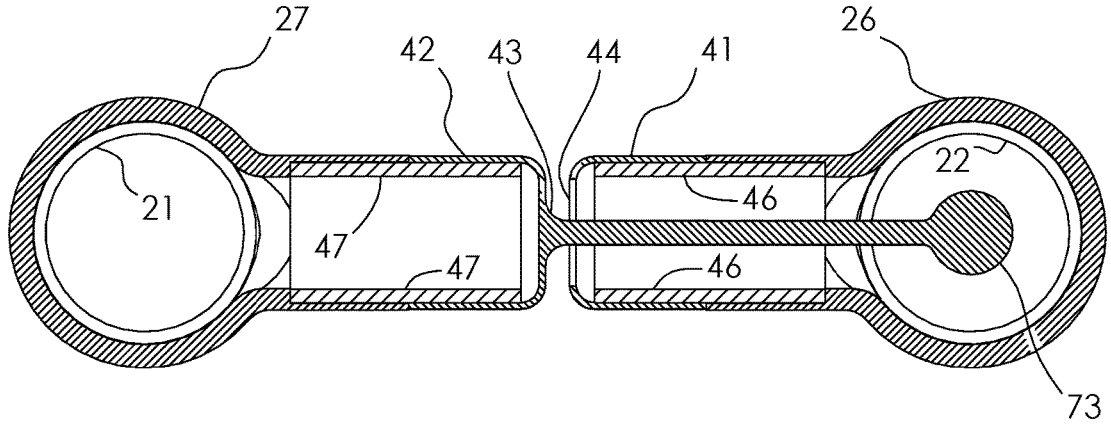
FIG. 9.
Figure 10:
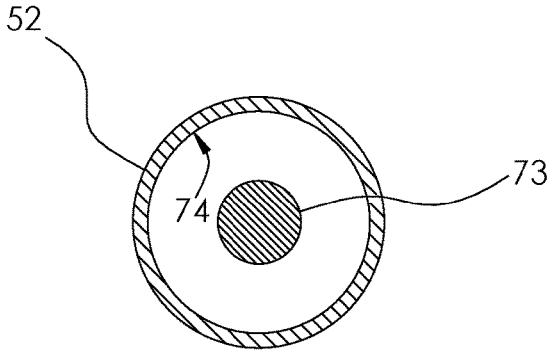
FIG. 10.

In the present invention, the series inductance of the feed conductors is reduced by using larger diameter conductors. Referring to FIG. 7, the point where the feed line attaches to the antenna assembly is moved inward from the feed tap tees (26)(27) and along very thick conductors (41)(42). FIG. 7 shows the two large conductors (41)(42) branching off the first and second feed tap tees (26)(27). The two cylinder conductors (41)(42) come together leaving a small gap or opening (45) between them. The cross-section in FIG. 5 shows the outboard second cylinder conductor (42) connecting to the feed point transition conductor (43). The feed point transition conductor (43) connects to the internal feed line (73) through an opening (44) in the first cylinder conductor (41). The feed point transition conductor (43) and feed point opening (44) form the end of an internal coaxial transmission line terminating at the feed point of the antenna (40). This method reduces inductance in series between the end of the feed line and the two parallel conductors (21)(22).

The internal feed line (73) may also be a self-contained radio frequency transmission line formed of coaxial cable routed within the hollow tube or tubes (if multiple tubes are soldered, for example, together) of the antenna structure. In this configuration, the coaxial cable is terminated at the feed point gap (45) with the center conductor of the coaxial cable affixed to the second cylinder conductor (42) and the shield of the coax brought out from the cable in an outward arrangement and mechanically attached to the first cylinder conductor (41) by means well-known in the art.

Both types of internal feed line described above mitigate the flow of common current down the antenna transmission line.

Another practical implementation is the traditional J antenna approach of attaching an external feed line, coaxial or parallel, across the feed point gap (45) leading away from the feed point spot (40). In this example, the internal feed line (73) is not present and the opening (44) is sealed with a conductive material. One conductor of the feed line attaches to the first cylinder conductor (41) close to the feed point gap (45) while the remaining conductor attaches to the second cylinder conductor (42) close to the feed point gap (45). This method does not mitigate the flow of current along the antenna transmission line. It is assumed a user of the antenna would follow the known best practice of radio frequency choking of the feed line. With proper radio frequency choking of the feed line, it will not matter if the center conductor of the transmission line is attached to the first (41) or second (42) cylinder conductor. The use of an external feed line still provides the user with the advantages of a thick conductor, low inductance feed point.

Mounting Mast Section

Figure 2:
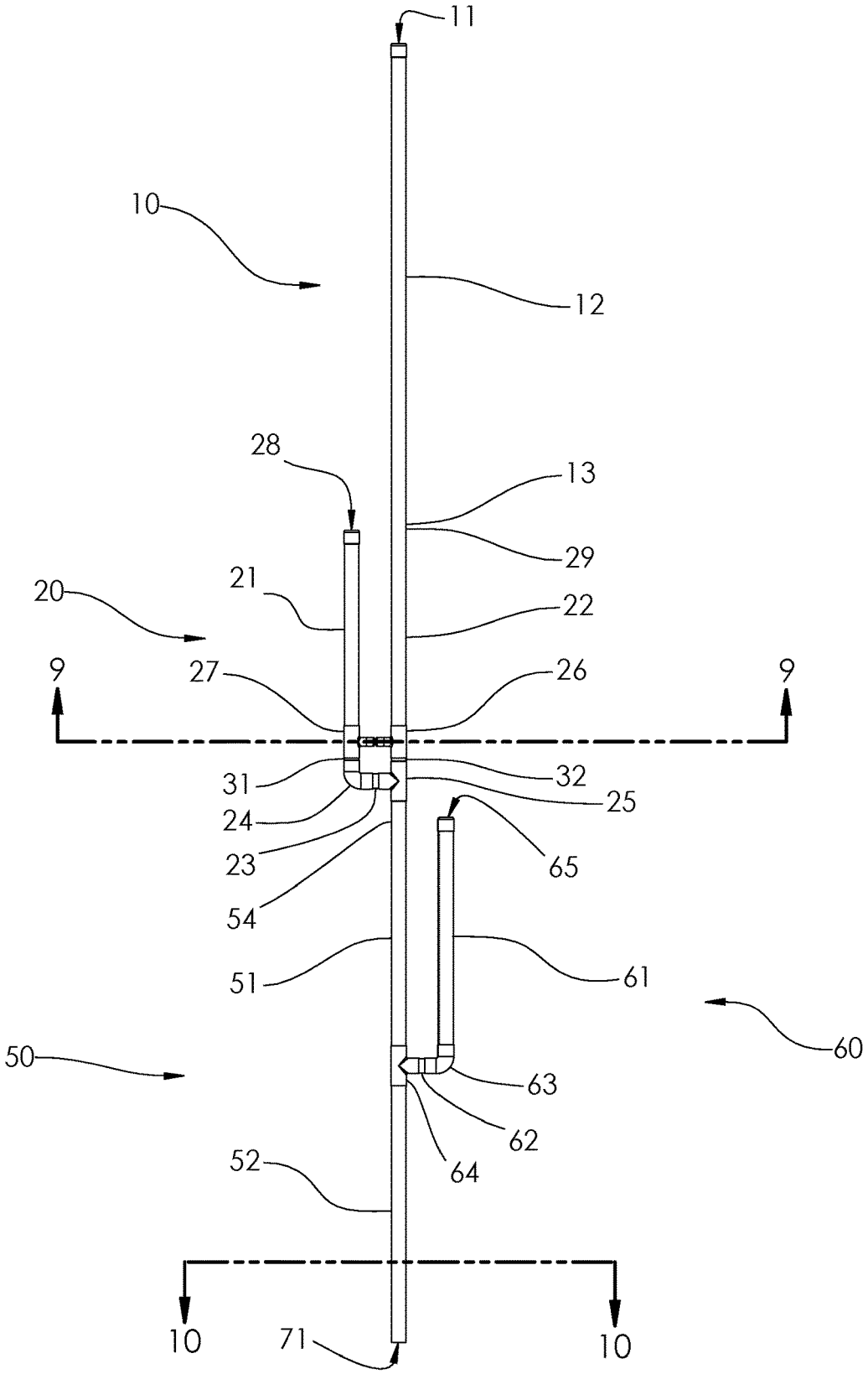
FIG. 2.
Figure 3:
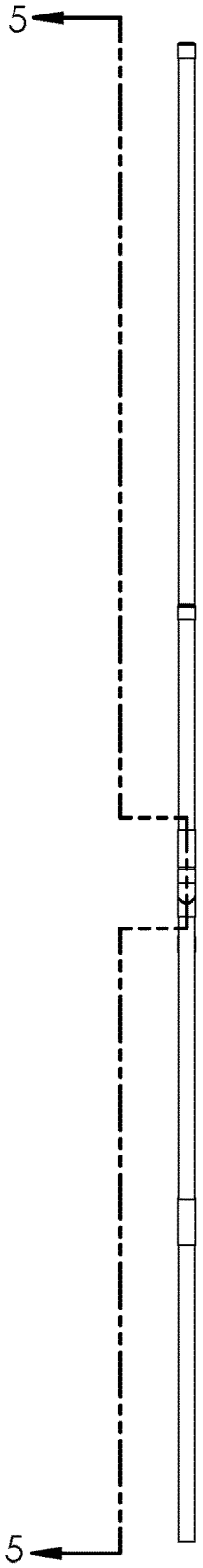
FIG. 3.
Figure 4:
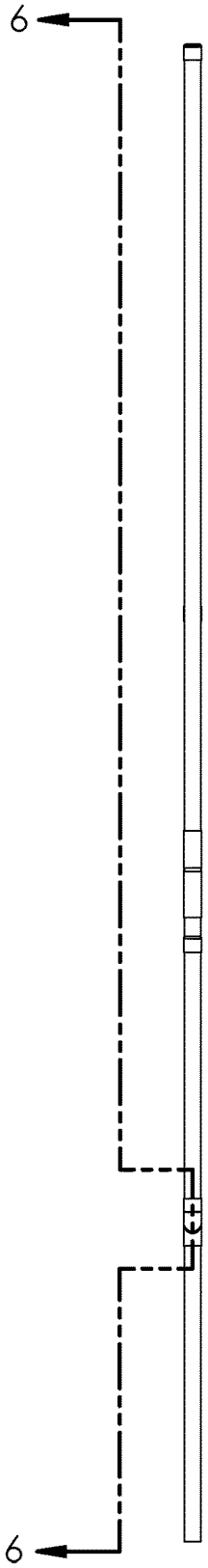
FIG. 4.

The mounting mast section (50) elements (54)(51)(52) (as shown in FIG. 2) mechanically connect the shorting end (23) and impedance transformer bottom tee (25) of the impedance transformer section (20) to the preferred mounting structure using any mechanical connection method known in the art. The mounting mast section (50) is at least one quarter-wave in length to provide the means to support the elements of the mast isolating stub section (60)(61)(62)(63)(64). The lower mounting mast member (52) below the mast isolating stub section (60) is mechanically connected to the mounting structure using any mechanical connection method known in the art. The mounting mast section (50) is made from a hollow conductor in a preferred embodiment of the invention.

The mounting mast top (54) connects with the bottom of the impedance transformer bottom tee (25). The upper mounting mast member (51) connects to the lower mounting mast member (52) and extends for as long as necessary to affix to a suitable mounting structure such as the tall mast of FIG. 13 (107). The upper mounting mast member (51) is placed well away from any mounting structure, because this member (51), along with the mast isolating stub side connector (61), becomes a form of parallel transmission line with corresponding sensitivity to nearby conductive objects, such as the mounting mast section (50). The lower mounting mast member (52) may be of any convenient length to mount the entire assembly to the mounting structure, such as a tall mast (107).

The mounting mast section (50) may be made of any linear conductive material of any shape. Tubing with square, rectangular, or polygon cross-section is preferred to provide the necessary support for the antenna components above the mounting mast section (50). For the antenna to conduct lightning surge currents to the support structure (such as the mast (107) in FIG. 13), the mounting mast section (50) must be made of a conductive material with sufficient lightning surge current carrying capacity.

Mast Isolating Stub Section

Figure 6:
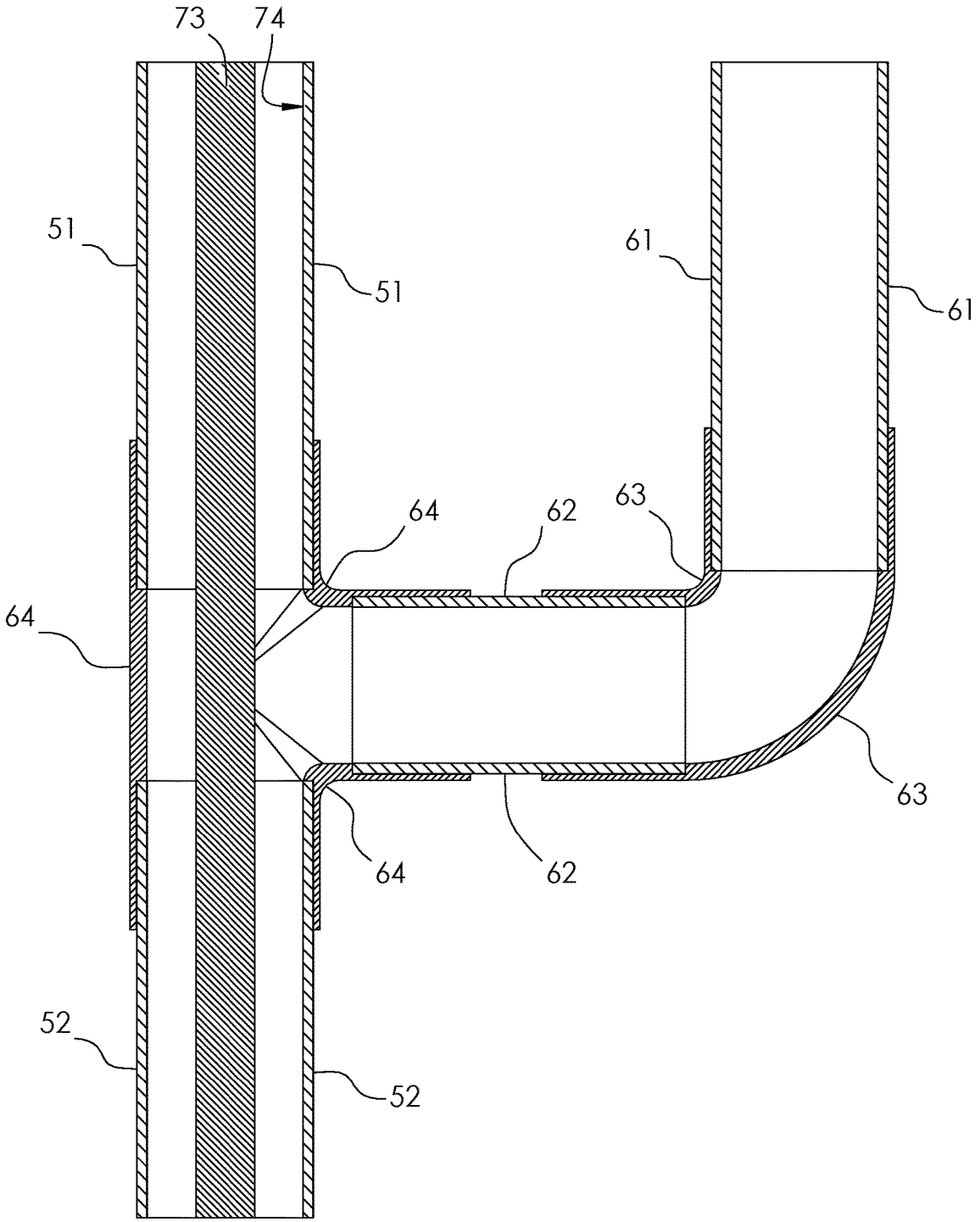
FIG. 6.

The mast isolating stub section (60) (as shown in FIGS. 2 and 6) is parallel with and offset from the upper mounting mast member (51). The bottom of the stub is a connecting shorting bar (62) that connects with the upper mounting mast member (51) approximately, for example, a quarter-wave beneath the, for example, quarter-wave transformer section (20) using a conductive elbow (63) and tee (64). The top (65) of the mast isolating stub section (60) is open and, in the preferred embodiment, oriented on the side opposite the transformer section (20). The mast isolating stub section (60) may be oriented on any side of the upper mounting mast member (51). The mast isolating stub section (60) is made from a solid or hollow conductor in a preferred embodiment of the present invention. The length of the mast isolating stub section (60) and parallel upper mounting mast member (51) may be, for example, one quarter-wavelength in length, or one quarter-wavelength plus one or more half-wavelengths in length.

Figure 11:
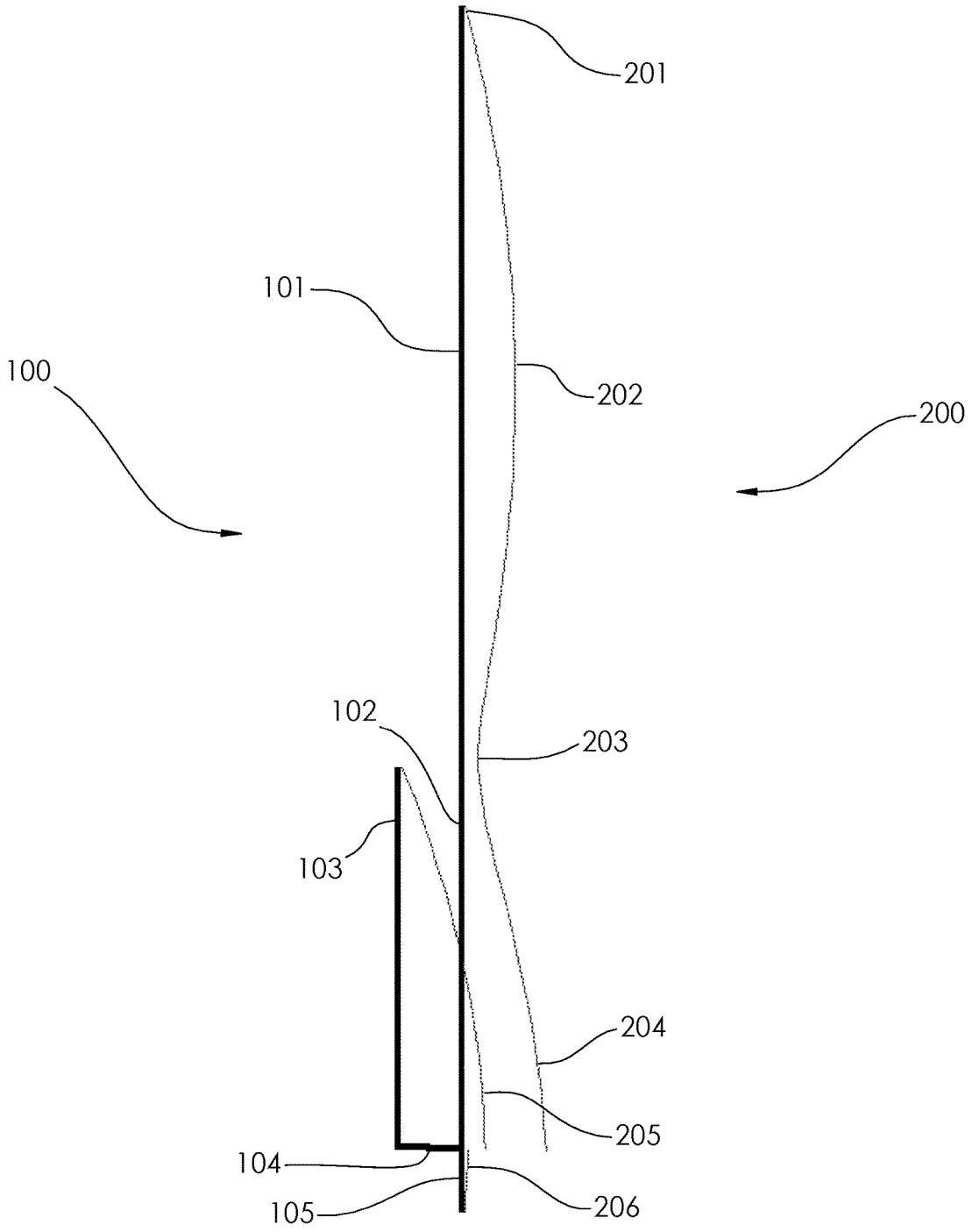
FIG. 11.
Figure 13:
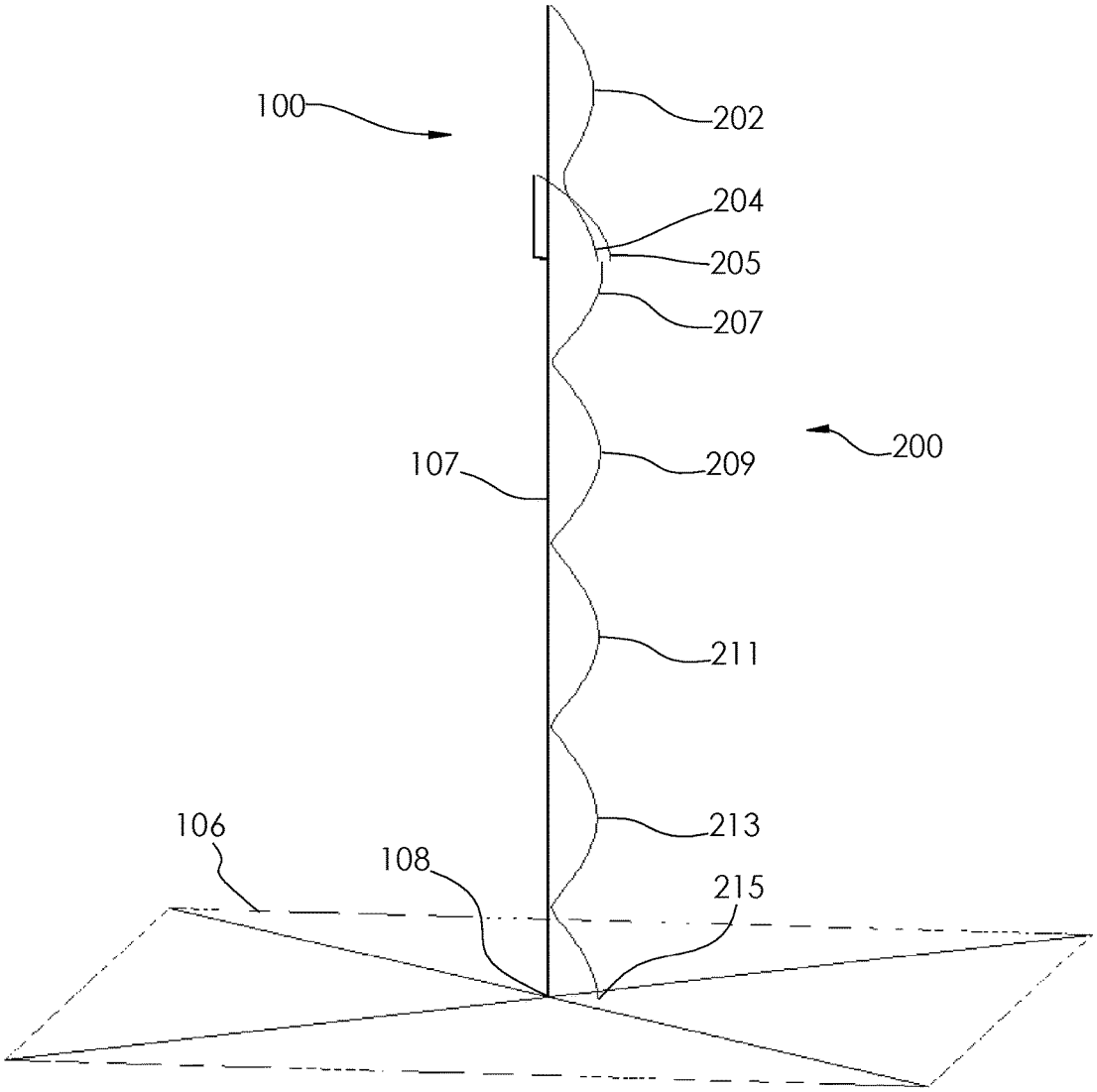
FIG. 13.

The traditional J antenna (100) (as shown in FIG. 11) provides no relief from radio frequency currents flowing along any connecting conductive structure as shown in FIG. 13. The addition of the mast isolating stub section (60) presents a relatively high impedance to the relatively low impedance point at the bottom portion (23)(24)(25)(31)(32) of the antenna assembly's impedance transformer section (20). This relatively high impedance and resulting mismatch in impedance serve to choke off currents that otherwise conduct along the mast.

The mast isolating stub section (60) creates a parallel transmission line system. The relatively high impedance point at the open end (65) of the mast isolating stub section (60) is converted to a comparatively low impedance along the length of the mast isolating stub side conductor (61), the mast isolating stub conductive elbow (63), the mast isolating stub connecting shorting bar (62), and the mast isolating stub tee (64). The parallel combination of the upper mounting mast member (51) and mast isolating stub section (60) forces the impedance along the upper mounting mast member (51) to be nearly identical to the impedance at the mast isolating stub free end (65). The high impedance at the top end of the upper mounting mast member (51) mirrors the defined high impedance point of the open or free end of the side conductor (65). The mast isolating stub section (60) functions as a form of radio frequency choke.

Any assembly that maintains two parallel electrical conductors and is approximately one quarter-wavelength, or one quarter-wavelength plus one or more half-wavelengths long will serve the role of mounting structure choke. The governing characteristics of the choking action depend on the characteristic surge impedance of the parallel conductors. In a preferred embodiment, self-supporting conductive pipe maintains the dimensions of the two parallel conductors (61)(51) and the distance between them. Ladder line also makes an excellent mast isolating choke. The parallel conductors may also be of different diameters.

Integral Coaxial Feed Line

The integral coaxial feed line internal inner conductor (also referred to as the internal feed line or transmission line) (73), in FIGS. 5, 6, 8, 9, and 10, is enclosed within the hollow conductors of the mounting mast section (50) components (52)(51)(54) and a portion of the impedance transformer inline member (the transformer lower inline conductor (32)), and extends from the bottom (71) of the mounting mast section (50) and ends at the low inductance feed point gap (45).

One disadvantage in the traditional J antenna is the fragile and awkward external feed line connection to the feed point between the two conductors of the impedance transformer. A preferred embodiment of the present invention places an internal feed line (73) inside the hollow conductive structure thereby extending the purpose of the lower conductive tube or tubes. This provides a more convenient bottom feed point of the antenna and serves to choke off radio frequency currents that would otherwise flow down the antenna system feed line. Additionally the robustness of the antenna is improved by keeping the relatively fragile transmission line contained within the relatively rugged antenna structure.

In an exemplary version of the present invention, hollow conductive tubing, such as piping, is used to construct the antenna assembly. By using concentric piping to construct the internal feed line (73) inside the hollow cylindrical volume defined by the diameter of the inner wall of the piping between the feed point at the bottom of the antenna (71) and the transformer inline feed tap tee (26), a high quality, low loss coaxial feed line results. The internal feed line (73) passes through the lower mounting mast member (52), isolating stub tee (64), upper mounting mast member (51), mounting mast top (54), impedance transformer bottom tee (25), impedance transformer lower inline conductor (32), and part way through the transformer inline feed tap tee (26). Best practices are applied to maintain the internal feed line (73) in the center of the piping using, for example, non-conductive spacers.

In alternative embodiments of the invention, the coaxial internal transmission feed line (73) passes by the internal openings in the transformer bottom tee (25) and the isolating stub tee (64). Unlike typical coaxial feed line or cable tee connections, the tees in the present invention do not contain concentric conductors in the tee portion perpendicular to the internal feed line (73). Consequently, the mode of operation for a hollow cylinder to convey electromagnetic energy is via waveguide theory. The dimensions of the waveguide existing at the tees' (25)(64) intersections are far smaller than the operational wavelength used to support any waveguide modes within the waveguide's area and volume. This effectively prevents the entry of electromagnetic energy into the right-angle cylinders at the tees (25)(64) rendering the effect of the openings on the internal feed line negligible. For the same reason, the electromagnetic energy flowing along the internal feed line (73) will not flow into the upper inline conductor (22) and will, instead, follow and flow along the internal feed line (73) out the left side of the inline feed tap tee (26) toward the feed point gap (45).

In another embodiment of the present invention, a radio frequency connector (not shown in the figures) may be attached to the bottom of the antenna structure (71) to accept an external transmission line. With this connection, the internal feed line (73) becomes an extension of the external transmission line terminating at the low inductance feed point gap (45). Owing to the principles of radio frequency skin effect, the radio frequency energy of the internal feed line is contained within the cylindrical walls of the conductive antenna structure. The only point where it is possible for radio frequency to exit the internal transmission line is at the feed point gap (45). The radio frequency current of the internal feed line (73) portion is conducted via the feed point transition conductor (43) to the feed point second feed cylinder conductor (42). The radio frequency current from the internal feed line (73) flows along the feed point transition conductor (43) to the second feed cylinder conductor (42), over the surface of the side feed tap tee (27), and finally to the impedance transformer upper and lower side conductors (21)(31), respectively. The radio frequency current on the inside surface of the outer conductor tube (74), in FIGS. 5, 6, 8, and 10, flows on the inner wall of the feed point gap first inner cylinder conductor (46) through and around the inside edge of the feed point opening (44), around the outside of the low inductance feed point first feed cylinder (41), over the surface of the inline feed tap tee (26), and finally to the impedance transformer upper and lower inline conductors (22)(32), respectively.

An alternative embodiment of the present invention may have the integral transmission line be a length of traditional coaxial cable. The coaxial cable center conductor would replace the feed point transition conductor (43) and connect to the second feed cylinder conductor (42). The coaxial cable shield conductor would connect to the feed point opening (44). The other end of the coaxial cable would terminate to a radio frequency connector below the quarter-wave mast isolating stub section (60) at the bottom of the antenna structure (71). Placing a coaxial cable inside the antenna structure would provide protection from weather and other degrading conditions known to age antenna components in outdoor environments. Additionally, the termination of the shield of the coaxial cable to the feed point opening (44) would place all possible common mode currents that might otherwise flow along the outside of the coaxial cable directly onto the antenna for radiating.

Connections of Main Elements and Sub-Elements

The affixed end (13) of the radiating conductor section (10) is connected to the upper inline conductor (22) of the impedance transformer section (20) at the transformer radiator feed point (29). Often, the radiating conductor section (10) and the upper inline conductor (22) are a single continuous member. The transformer upper inline conductor (22) is connected to the top of the inline feed tap tee (26). The inline feed tap tee (26) is connected to the impedance transformer lower inline conductor (32). The impedance transformer lower inline conductor (32) is connected to the impedance transformer bottom tee (25). The impedance transformer connecting bar (23) connects the impedance transformer bottom tee (25) and the transformer elbow (24). The impedance transformer lower side conductor (31) connects the transformer elbow (24) and the side feed tap tee (27). The impedance transformer upper side conductor (21) connects to the side feed tap tee (27). All connections can be made by methods known in the art.

The low inductance feed point first feed cylinder (41) is connected to the inline feed tap tee (26). The low inductance feed point gap first inner conductive cylinder (46) joins the feed point first feed conductive cylinder (41) and inline feed tap tee (26). The low inductance feed point second feed cylinder (42) is connected to the side feed tap tee (27). The low inductance feed point gap second inner conductive cylinder (47) joins the feed point second feed conductive cylinder (42) and side feed tap tee (27). The low inductance feed point first feed cylinder (41) and second feed cylinder (42) are arranged co-linearly and directed toward each other leaving a feed point gap (45). An external feed line (not shown in the figures) or internal feed line (73) is attached across the feed point gap (45) to energize the antenna.

In another embodiment of the invention, a method of feeding the antenna employs an internal feed line inner conductor. In this alternative embodiment, additional connections are made to the antenna, including, but not limited to: placing a tubular conductor, such as an internal feed line (73), within the inline piping such that the feed line remains centered within the conductive tubing using best practices, such as employing non-conductive spacers; and having a protrusion exit the top of the internal inner conductor (73) within the inline tap tee (26) and exiting the low inductance feed point opening (44) to connect with the opposite low inductance feed point cylinder conductor (42) via a transition conductor (43). The internal feed line (73) forms a coaxial transmission line from the bottom of the antenna structure (71) to the low inductance feed point gap (45) in combination with the inside surface of the outer conductor tube (74) along the entire length of the internal feed line (73). There are no common mode currents available to travel down any transmission line as the exterior of the inline tubing is part of the antenna. This negates the requirement for radio frequency transmission line choke techniques.

Another alternative method that may be used to provide an internal feed line is to insert flexible coaxial cable through the inline tubing. The coaxial cable center conductor becomes the feed wire, i.e., transition conductor (43), that connects to the low inductance feed point second feed cylinder (42). The shield of the internal coaxial cable is mechanically joined to the rim of the feed point opening (44). The current flowing on the coaxial cable's shield would then flow to the exterior of the antenna via the outside surface of the low inductance feed point first feed cylinder (41) and inline tap tee (26). In this way, no common mode currents would be able to flow back down the outside of the shield of the internal coaxial cable, which would negate the need for radio frequency transmission line choke techniques.

The mounting mast top (54) and upper mounting mast member (51) are attached between the impedance transformer bottom tee (25) and the mast isolating stub tee (64). The lower mounting mast member (52) is attached to the opposite, bottom side of the mast isolating stub tee (64). The mast isolating stub connecting shorting bar (62) is attached to the side port of the mast isolating stub tee (64). The mast isolating stub conductive elbow (63) connects to the end of the mast isolating stub connecting shorting bar (62). The mast isolating stub side conductor (61) connects to the mast isolating stub conductive elbow (63) and is oriented parallel to the upper mounting mast member (51) with the mast isolating stub free end (65) above the mast isolating stub conductive elbow (63).

The various connections described throughout the specification can be made by soldering, for example, or by other means known in the art.

Alternative Embodiments of the Invention

In an alternative to the mast mountable antenna of FIGS. 1 and 2, the hollow, electrically conductive tubing is replaced with solid conductors. The simulated antennas shown in FIGS. 11, 12, 13, 14, and 15 represent solid conductors. FIG. 15 illustrates this alternative embodiment of the present invention less the internal feed line. The internal feed line (73) and the low inductance feed point (40) are not represented in this embodiment (nor in FIG. 15). An external feed line is used instead of the internal feed line since the conductors in FIGS. 11, 12, 13, 14, and 15 are solid. This alternative embodiment performs the mast decoupling function by separating the antenna structure from its mounting structure.

In another alternative of the mast mountable antenna of FIGS. 1 and 2, the end-fed radiating conductor section (10) is replaced by any radiating antenna component with high impedance connection point (13) joined to the impedance transformer section (20) at the transformer radiator feed point (29).

Operation of a Preferred Embodiment of the Invention

To understand the operation of the mast mountable antenna, it is helpful to understand the problem it solves. This requires an understanding of the operation of the traditional J antenna. FIG. 11 illustrates a traditional J antenna, as described in, for example, U.S. Pat. No. 2,124,424. This J antenna has an end-fed, electrical, half-wave radiating conductor (101) fed by a quarter-wave transformer conductor section (102)(103). The bottom of the quarter-wave parallel transformer side conductor (103) is shorted by a quarter-wave transformer shunt conductor (also known as a shorting bar) (104). The junction between the shorting bar (104) and the quarter-wave transformer inline conductor (102) is connected to an electrically short antenna mounting mast (105). Energy may be applied anywhere along the conductor path (101)(102)(104)(103) to effectively analyze the operation of the antenna, thus negating the need for a shunt feed, e.g., a low inductance feed point (40). In this example, the simulation energy is placed in series along the shorting bar (104) to energize the antenna assembly (100). When energized, the antenna resonates as if it were a one-electrical wavelength conductor given that the total wavelength of the conductors consists of the half-wave radiating conductor (101), the quarter-wave transformer inline conductor (102), the shorting bar (104), and the quarter-wave transformer side conductor (103).

When using an alternating current of frequency with an electrical wavelength equal to the total electrical wavelength of the conductors (101)(102)(104)(103), the magnitude and location of the radio frequency current standing waves (201)(202)(203)(204)(205)(206) occur as shown in FIG. 11. The current antinode (202) in the half-wave radiating conductor (101) forms the traditional dipole with voltage peak and current minimum at the dipole top, more specifically termed the half-wave radiating conductor open end high voltage point (201) and bottom, more specifically termed the half-wave radiating conductor and quarter-wave transformer voltage maximum (203), respectively. The quarter-wave transformer inline and side conductor currents (204)(205), respectively, in the quarter-wave transformer conductor section (102)(103) are equal and opposite, thus negating most of their combined far-field radiation via cancellation. The short mounting mast (105) draws a small amount of current (mounting mast conductor current) (206), but, due to a length much shorter than the radio frequency's electrical wavelength, and resulting small current, that is of little consequence to the far-field pattern.

Figure 12:
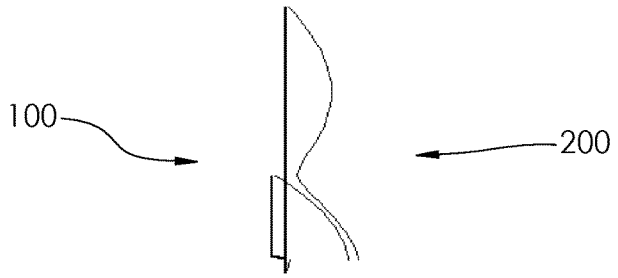
FIG. 12.
Figure 12:
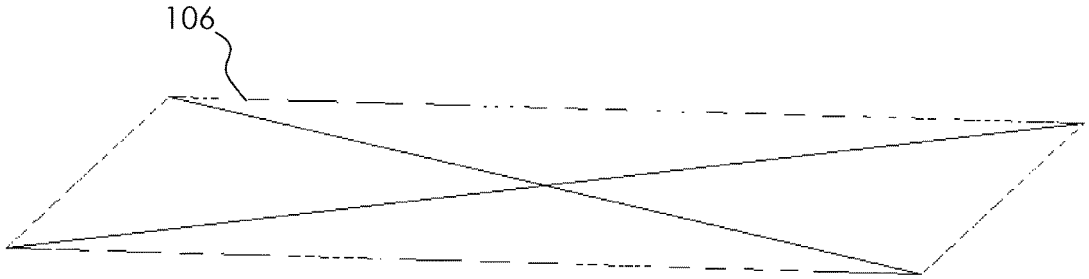
Figure 16:
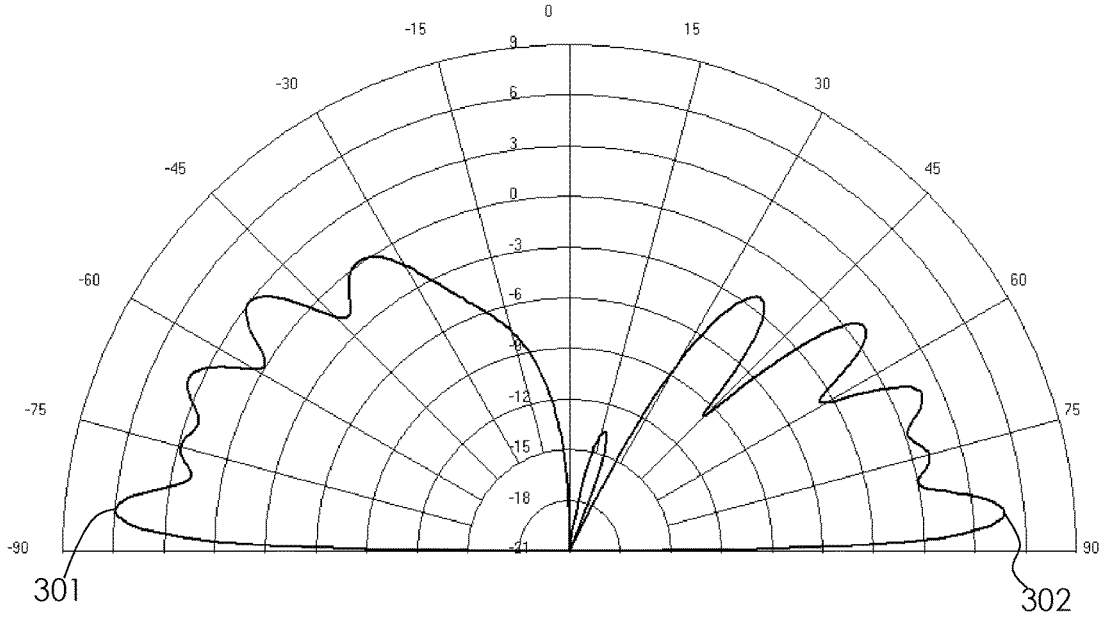
FIG. 16.

To properly analyze the antenna structure (100) in FIG. 11, it must be located above a simulated ground (106), as shown in FIG. 12, wherein the simulated ground (106) has representative properties of conductivity and dielectric value. When energized by a simulated source of radio frequency energy at a frequency matching the antenna's operational resonance, the far-field gain pattern shown in FIG. 16 is generated. FIG. 16 shows the standard E-plane elevation cut with radial units in dBi and angle units in degrees. The point of maximum gain (301) is toward the side conductor (103) of the J antenna structure (100). The next highest gain point (302) is directly opposite the side conductor (103). As is evident from FIG. 16, the antenna maintains energy close to the ground at approximately 6 degrees elevation governed in part by the height above and interaction with the simulated ground (106). This desirable antenna behavior relies on the fact that the antenna structure in FIG. 11 is isolated in free space with no conductivity of energy anywhere, but on the antenna's elements (101)(102)(103)(104)(105). The small mounting mast conductor current (206) on the antenna mounting mast (105) is low enough to not compromise the desirable antenna pattern shown in FIG. 16.

Figure 17:
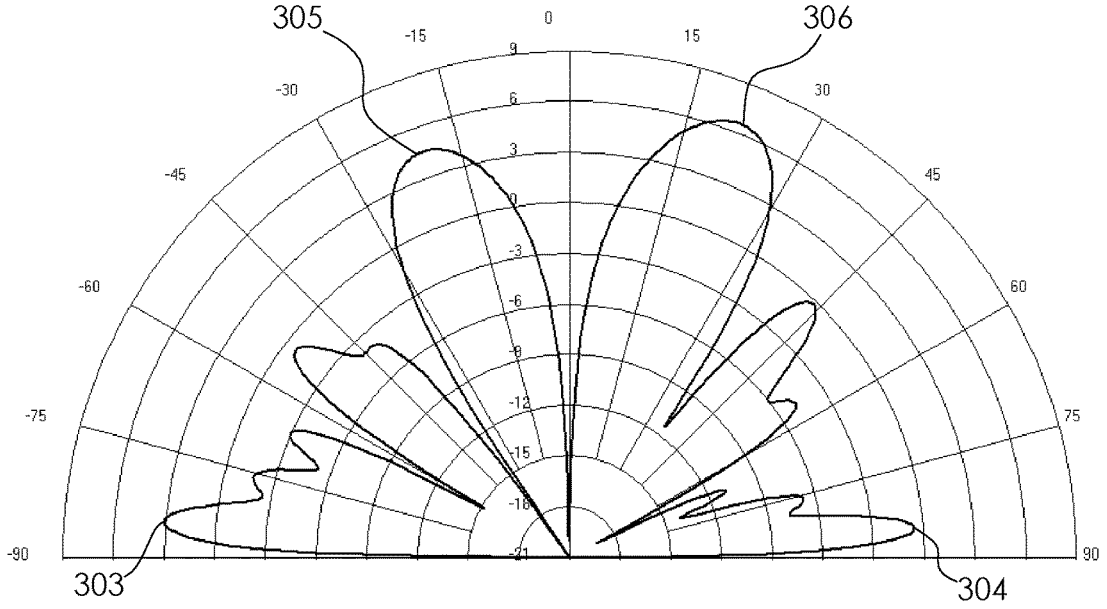
FIG. 17.

To properly evaluate the antenna in a real world situation, the arrangement in FIG. 13 is employed, wherein an elongated mounting mast (107) is shown. This arrangement is nearly identical to that shown in FIG. 12 with the replacement of the short mounting mast (105) of FIG. 11 with a practical, longer mounting mast (107) that connects the bottom of the J antenna structure (100) to the simulated ground (106) at the ground connection (or contact) point (108). The magnitudes of the current standing wave peaks (207)(209)(211)(213)(215) reveal the primary issue with mounting the J antenna on a conductive structure. The standing wave currents on the mounting mast (107) behave as a long-wire antenna resulting in the far-field elevation pattern shown in FIG. 17, wherein some energy is directed toward the horizon (303)(304), but a considerable amount of energy is wasted skyward (305)(306). This is a problem with antenna mounting structures having no means to quench induced current flow along the mounting structure.

Figure 14:
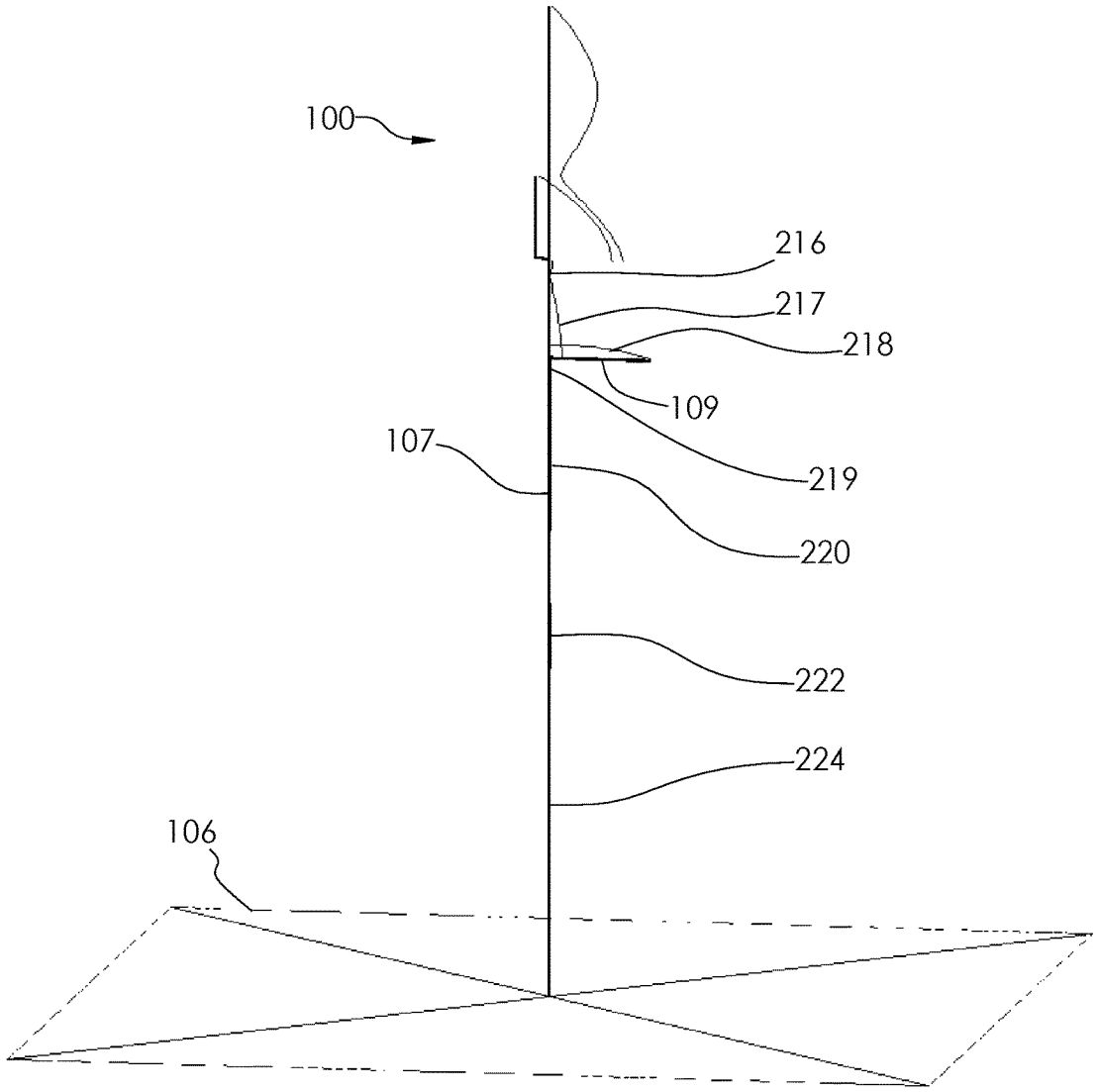
FIG. 14.
Figure 15:
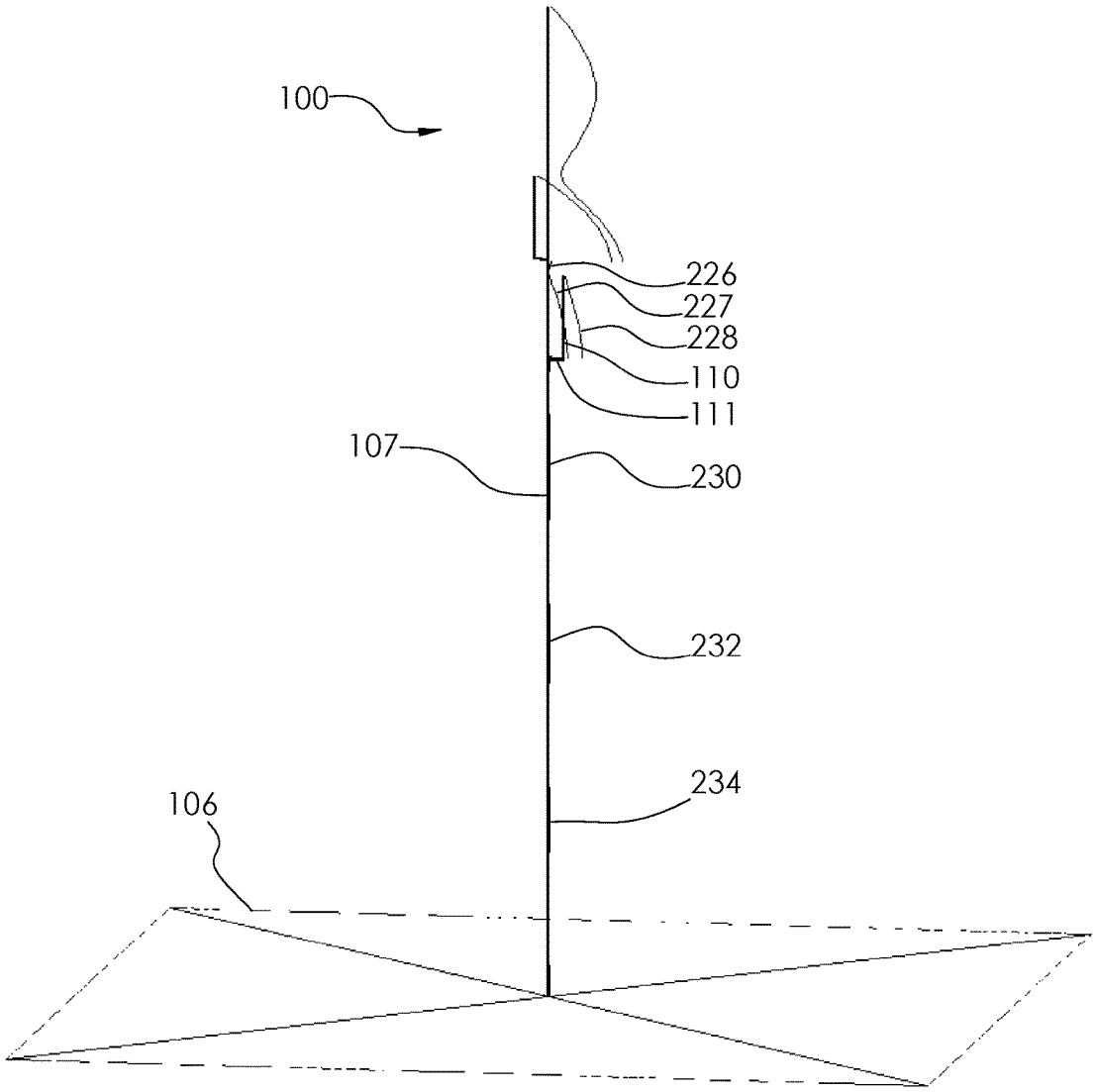
FIG. 15.
Figure 18:
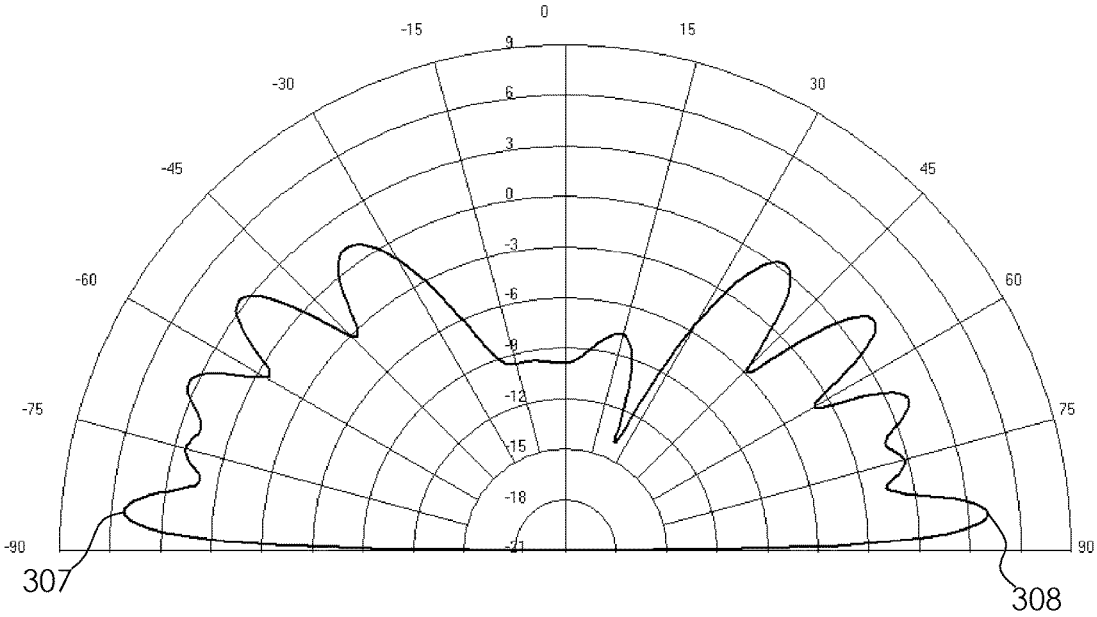
FIG. 18.

One popular method of mitigating radio frequency current flow on a conductor is with a quarter-wave radial conductor (109), an example of which is shown in FIG. 14. FIG. 14 is nearly identical to FIG. 13 with the addition of one radial conductor (109) perpendicular to the mounting mast (107) and mounted approximately one-quarter wavelength below the bottom of the J antenna structure (100). The tip of the radial conductor (109) has a high voltage, low current point that is reflected back to the base of the J antenna, one-half wavelength away. The high impedance at this point is sufficiently different from the low impedance at the bottom of the J antenna structure (100) to effectively choke or resist the flow of current to the mounting mast (107) despite the mast's propensity to draw current from the antenna. The far-field emission from the radial conductor (109) is not 100% countered by an equal, opposite, and parallel current, which results in some deleterious effects on the antenna's elevation pattern, as illustrated in FIG. 18. In addition, the high voltage at the top of the radial conductor (109) induces some energy into the portion of the mounting mast (107) below the radial conductor (109). The far-field pattern shown in FIG. 18 is reasonably well-behaved and almost identical to the stand-alone antenna pattern illustrated in FIG. 16.

Figure 19:
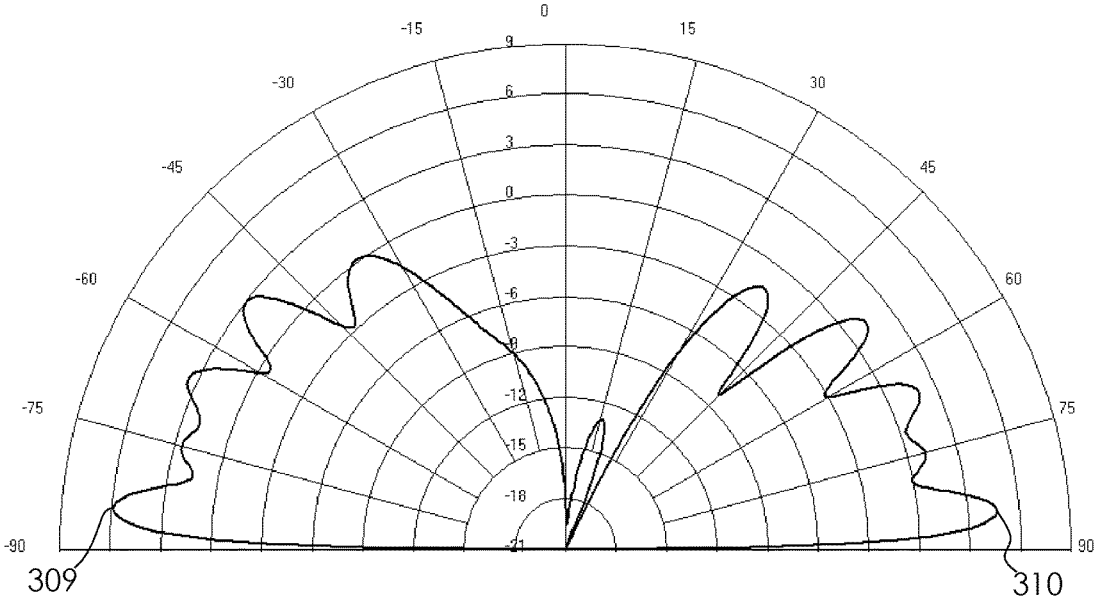
FIG. 19.

FIG. 15 illustrates the J antenna structure (100) and mounting mast (107) of FIG. 13 with the addition of a quarter-wave decoupling stub (110) arranged parallel to the mounting mast (107) with the bottom shorted to the mast with a shorting bar (111) one-quarter wave down from the bottom of the J antenna structure (100). The standing wave mast current peaks (230)(232)(234) are significantly less than the mast current peaks (207)(209)(211)(213)(215) of the untreated, i.e., no provisions added to mitigate radio frequency current flow, mounting mast (107) of FIG. 13. Being parallel with the mounting mast (107), the upper mast current (227) and the current in the parallel stub (228) are equal and opposite resulting in significant cancellation of the far-field energy. The high voltage top of the decoupling stub (110) cannot induce energy into the mounting mast (107), because of the distance between them. The pattern that results from this arrangement is shown in FIG. 19. The pattern shown with peaks (309)(310) in FIG. 19 is almost identical to the pattern of the stand-alone J antenna structure (100) shown in FIG. 16. As described herein, however, the arrangement of the antenna structure of the present invention performs the task of isolating the mounting mast structure at the operating frequency, while preserving low frequency conductivity for lightning surge management.

Figure 20A:
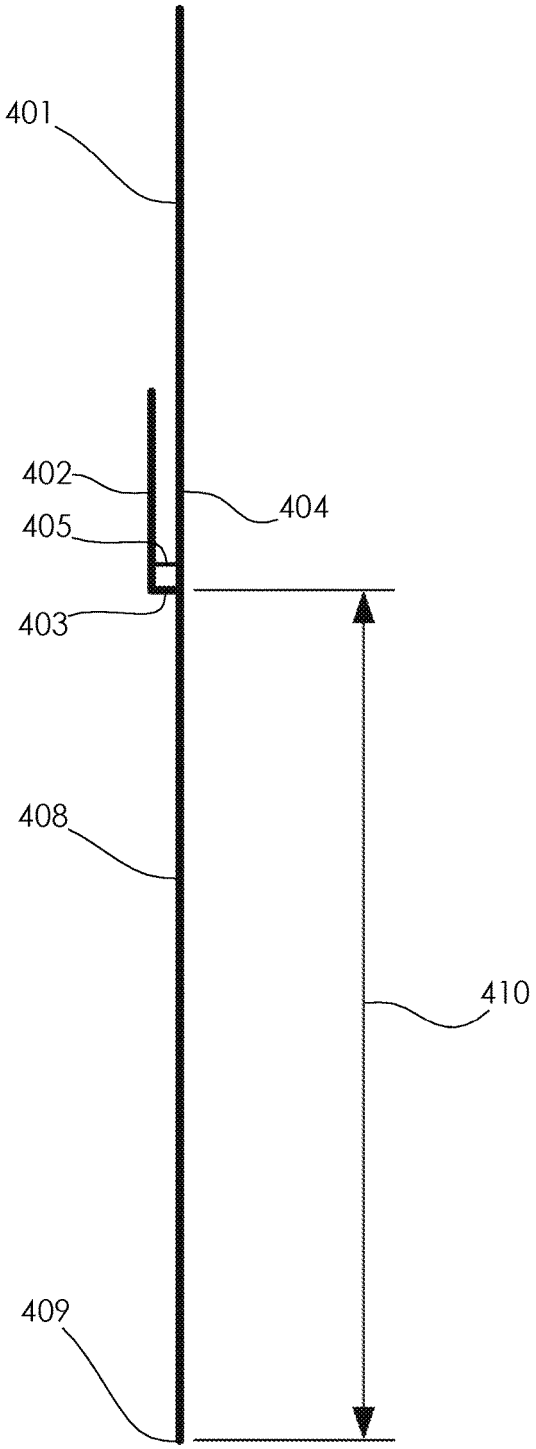
FIGS. 20A and 20B.
Figure 20B:
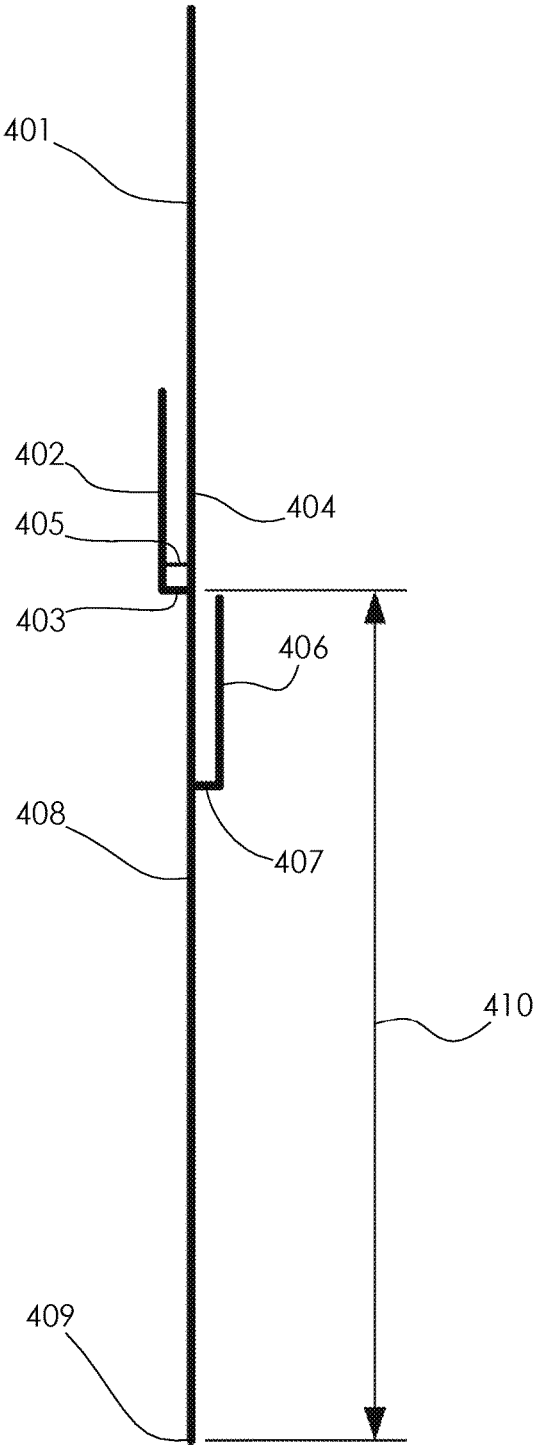

FIGS. 20A and 20B detail the construction of a prototype test antenna based on the techniques described herein. The antenna was built with dimensions for operation at a radio frequency of approximately 1 GHz with a resulting frequency at 1.06 GHz. FIG. 20A shows the common J antenna construction with a half-wave radiating conductor (401) of approximately 13.5 cm length and a "U" shaped quarter-wave transformer comprised of an inline conductor (404) of approximately 7 cm length, a horizontal conductor (403) of approximately 0.9 cm length, and a stub conductor (402) of approximately 7 cm length parallel with and offset from the inline conductor (404). The feed point (405) consists of a folded balun (not shown in the figures) oriented perpendicular to the antenna's vertical axis and perpendicular to the plane common with and through all the conductive elements. This feed system attaches to the feed point (405). A conductive mast (408) connects to the bottom of the J antenna at the intersection of two quarter-wave transformer elements (conductors (403)(404)). The conductive mast (408) hangs below the J antenna (401)(402)(403)(404) with the end (409) hanging in free space. The length of the conductive mast (408) can vary from approximately 8 to approximately 30 cm in approximately 1 cm steps along the dimension indicator (410) for all tests.

FIG. 20B shows the same antenna in FIG. 20A with the addition of mast isolating stub components to include a horizontal conductor (407) of approximately 0.9 cm length and a quarter-wave conductor (406) of approximately 7 cm length.

Figure 21A:
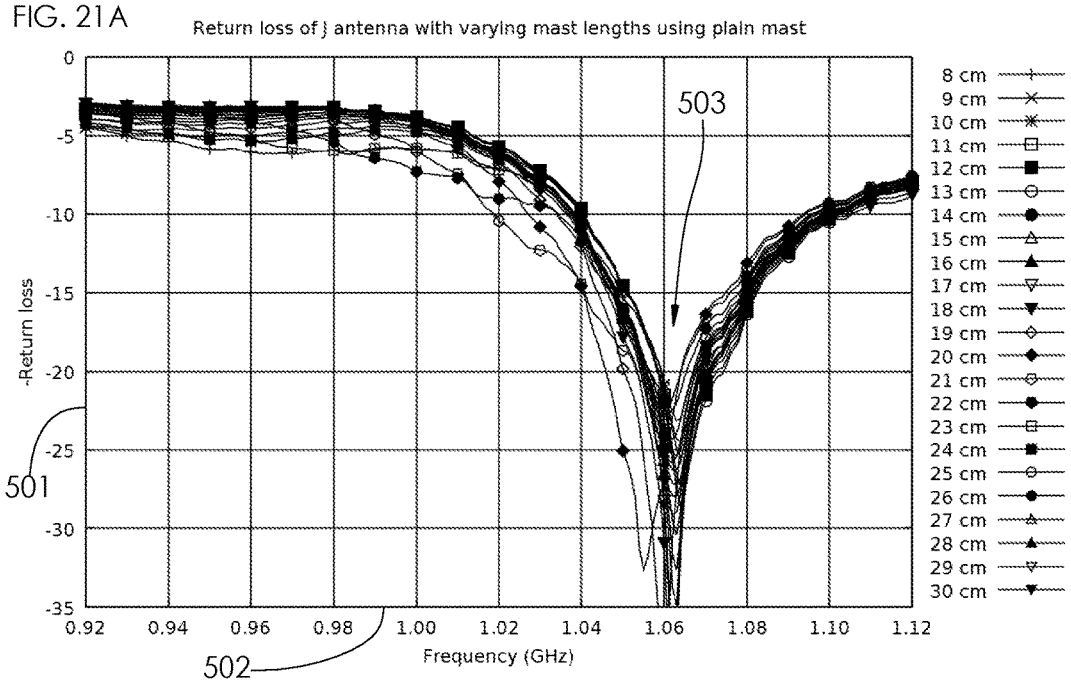
FIGS. 21A and 21B.
Figure 21B:
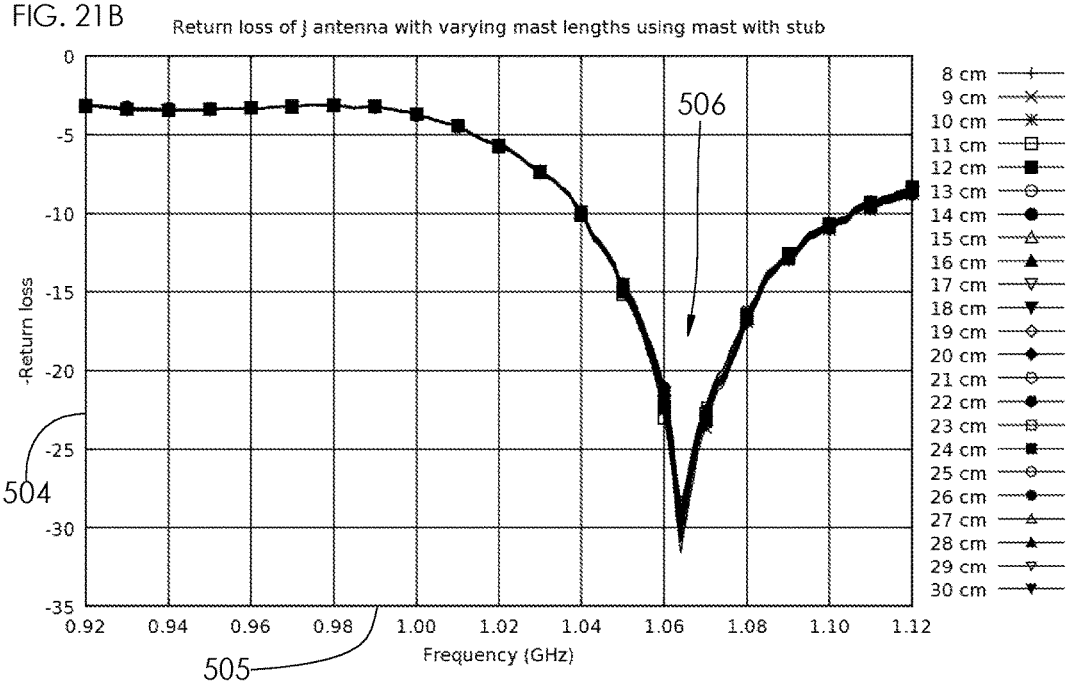

FIG. 21A shows the return loss plots (503) of the prototype antenna of FIG. 20A without the mast isolating stub components (406)(407) at various mast lengths (410). The return loss plots (503) reveal a correlation between mast length and the measured return loss (501) values and confirm a dependence on the length of the conductive mast (408). FIG. 21B shows the return loss plots (506) of the prototype antenna of FIG. 20B with the mast isolating stub components (406)(407) at various mast lengths (410). The return loss plots (506) coalesce and become independent of mast length confirming the operation of the mast decoupling function of the mast isolating stub components (406)(407).

The 50-ohm return loss (501) vs. frequency (502) at various mast lengths plotted in the graph of FIG. 21A reveal how the length of the conductive mast (408) perturbs the impedance at the feed point (405) of the J antenna (401)(402)(403)(404) of FIG. 20A. In contrast, the 50-ohm return loss (504) vs. frequency (505) at various mast lengths plotted in the graph of FIG. 21B reveal how the addition of the mast isolating stub components (406)(407) of FIG. 20B prevents the impedance presented by the conductive mast (408) from affecting the natural impedance of the J antenna (401)(402)(403)(404) at the feed point (405).

Figure 22A:
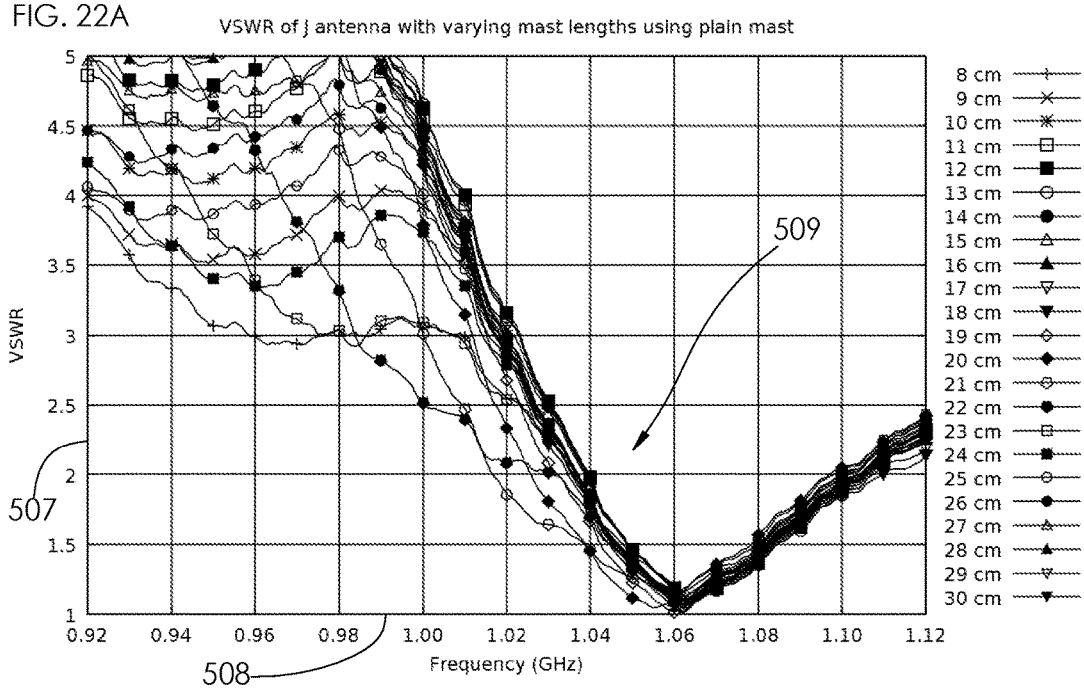
FIGS. 22A and 22B.
Figure 22B:
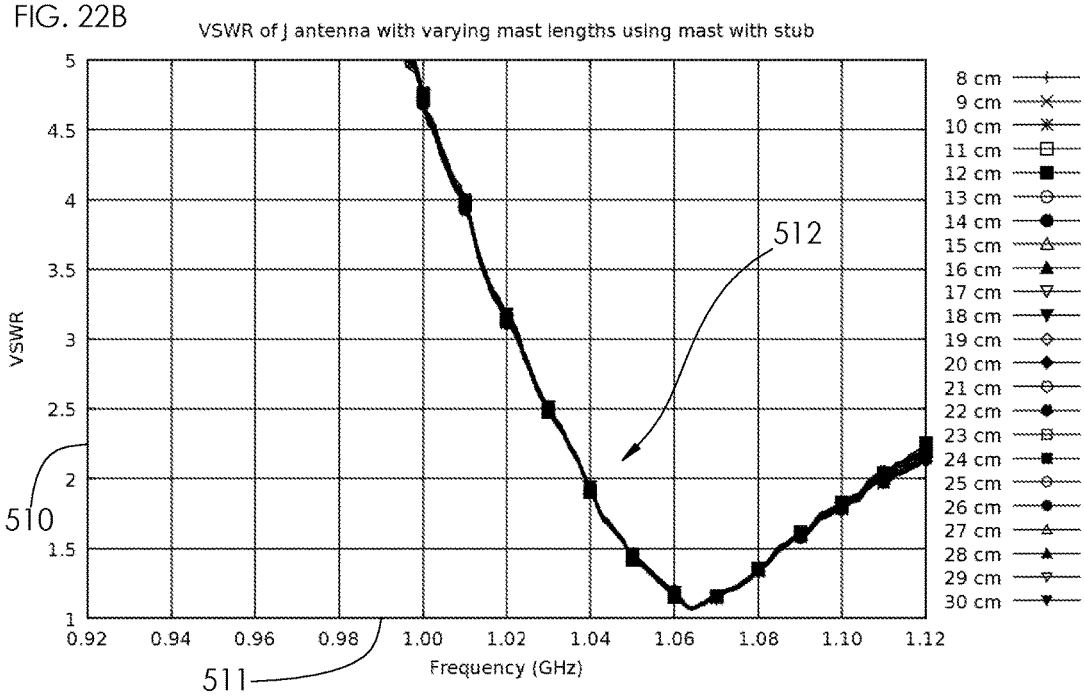

FIG. 22A shows the VSWR plots (509) of the prototype antenna of FIG. 20A without the mast isolating stub components (406)(407) at various mast lengths (410). The VSWR plots (509) reveal a correlation between mast length and the measured VSWR (507) values and confirm a dependence on the length of the conductive mast (408). FIG. 22B shows the VSWR plots (512) of the prototype antenna of FIG. 20B with the mast isolating stub components (406)(407) at various mast lengths (410). The VSWR plots (512) coalesce and become independent of mast length, which confirms the mast decoupling function of the mast isolating stub components (406)(407).

Figure 23A:
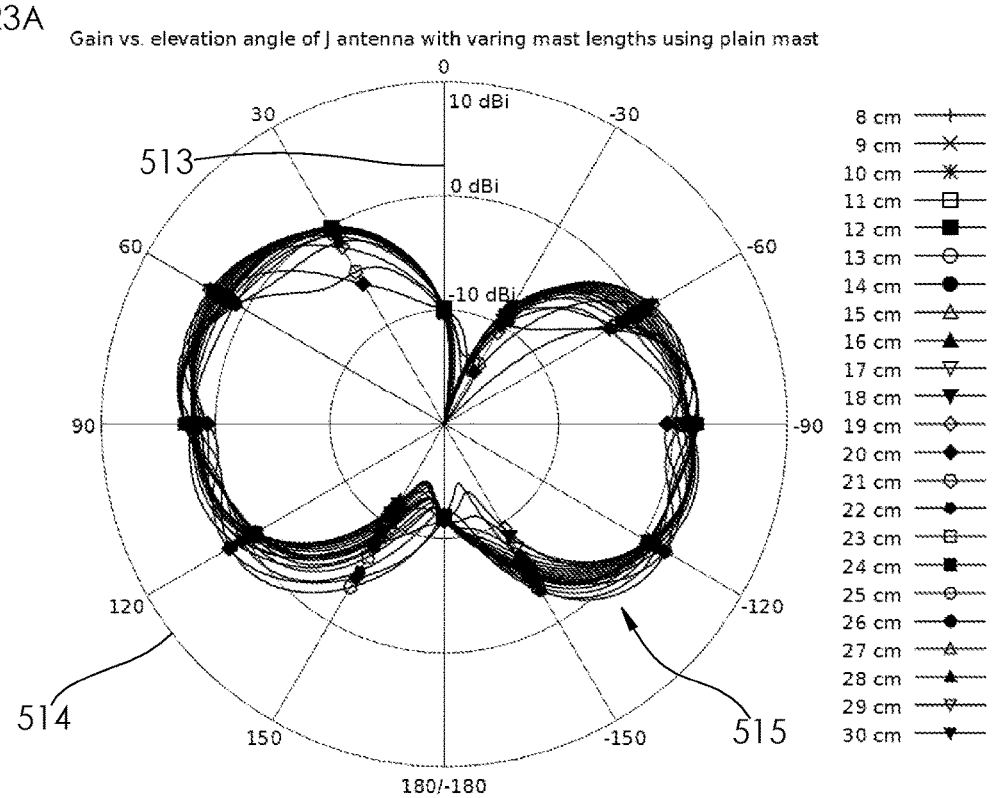
FIGS. 23A and 23B.
Figure 23B:
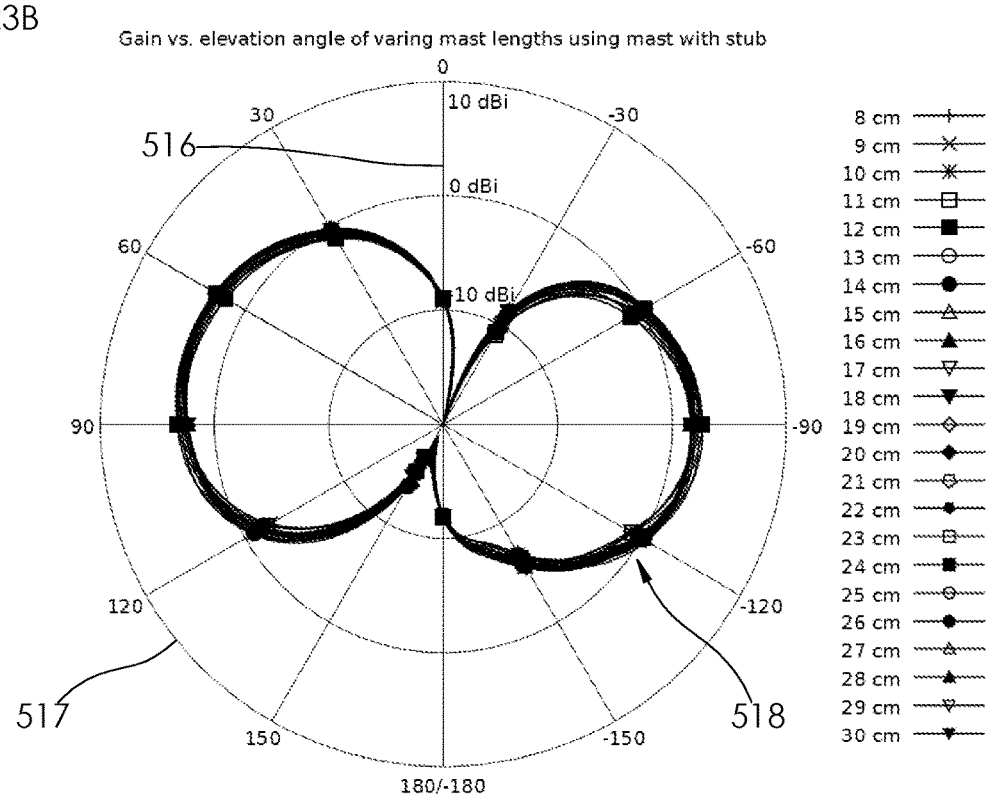

FIGS. 23A and 23B show the measured gains (513)(516), respectively, in the E-plane of the antennas in FIGS. 20A and 20B, respectively, taken along the plane coplanar with all J antenna elements (401)(402)(403)(404)(405) and conductive mast (408). The theta angle of 0 degrees is above the half-wave radiating conductor (401). The theta angle of 90 degrees is in the direction of the transformer stub (402). FIG. 23A shows the measured gain (513) in the E-plane of the prototype antenna of FIG. 20A without the mast isolating stub components (406)(407) at various mast lengths (410). The measured gain traces (515) reveal a correlation between mast length and measured gain (513) values and confirm a dependence on the length of the conductive mast (408). FIG. 23B shows the measured gain (516) in the E-plane of the prototype antenna of FIG. 20B with the mast isolating stub components (406)(407) at various mast lengths (410). The measured gain traces (518) coalesce and become independent of mast length, which confirms the mast decoupling function of the mast isolating stub components (406)(407).

The measurement data in FIGS. 21, 22, and 23 demonstrate that the addition of a mast decoupling stub to the traditional J antenna tames mast currents and provides an antenna immune to the effects of the structure upon which it is attached.

Operation of a preferred embodiment of the present invention, as shown in, for example, FIG. 1, 2, 3, 4, 5, 6, 7, 8, 9, or 10, involves the user selecting a suitable mounting location for an antenna to operate in the, for example, land-mobile service. The user installs or selects a conductive or non-conductive mounting structure at the desired location, with a conductive mounting structure preferred for managing lightning surge currents. The user then takes an embodiment of the present invention and attaches it to the mounting mast component by joining the lower mounting mast member (52) to the mounting mast using best practices in the art. The user must ensure the mounting mast overlaps only the lower mounting mast member (52) and not the upper mounting mast member (51). The user must also apply best practices of antenna installation including, but not limited to, ensuring that all components above the lower mounting mast member (52) of the antenna structure are well away from nearby conductive materials. Best practices include, but are not limited to, ensuring the induction fields do not interact with nearby conductive materials to avoid perturbing the far-field pattern of the half-wave radiating conductor section (10), and thus compromising the operation of the quarter-wave impedance transformer section (20) and the operation of the quarter-wave mast isolating stub section (60). Induction fields exist around the half-wave radiating conductor section (10), the quarter-wave impedance transformer section (20), and the quarter-wave mast isolating stub section (60). To ensure proper operation of the present invention, each of these sections must not be near conductive materials. Once the antenna structure is installed on its mounting mast structure, the user may install a coaxial feed line from the radio equipment to the feed point at the bottom of the antenna structure (71).

In another preferred embodiment of the present invention, the antenna assembly is unaffected by the mounting mast structure beneath it. In addition, the electrical continuity of the antenna structure to the mounting mast and then to ground is such that lightning surge currents have a direct path to ground. The present invention electrically shorts the two feed line conductors at frequencies much lower than the operating frequency at the low inductance feed point (40) along with the conductors forming the bottom "U" portion of the quarter-wave impedance transformer section (20). At frequencies present in lightning surge events, this electrical path is a direct short ensuring no high voltages appear across the conductors of the feed line.

In another preferred embodiment of the present invention, the antenna assembly mitigates radiation from the user-supplied feed line, because the design of the low inductance feed point (40) and internal feed line (73) does not provide a path for common mode currents. The antenna assembly of the present invention provides no opportunity for interior coaxial feed line shield currents to wrap around to the exterior of the feed line as the exterior is the outside surface of the quarter-wave transformer conductors. The interior feed line currents wrap around to the exterior of the antenna conductors at the low inductance feed point opening (44) of the low inductance feed point first feed cylinder conductor (41).

INDEX OF ELEMENTS

The names of the elements used throughout the specification and in the drawings may vary by, for example, shortening the name or rearranging the terms within the name. Name variations have no effect on the function or reference number of the respective element.

1*x*: Radiating Conductor
10: Radiating Conductor Section
11: Radiating Conductor Free End
12: Radiating Conductor Midpoint
13: Radiating Conductor Affixed End
2*x*-3*x*: Impedance Transformer
20: Impedance Transformer Section
21: Impedance Transformer Upper Side Conductor
22: Impedance Transformer Upper Inline Conductor
23: Impedance Transformer Conductive Connecting Bar
24: Impedance Transformer Conductive Elbow
25: Impedance Transformer Bottom Conductive Tee
26: Impedance Transformer Inline Feed Tap Conductive Tee
27: Impedance Transformer Side Feed Tap Conductive Tee
28: Impedance Transformer Free End
29: Impedance Transformer Radiator Feed
31: Impedance Transformer Lower Side Conductor
32: Impedance Transformer Lower Inline Conductor
4*x*: Low Inductance Feed Point
40: Low Inductance Feed Point
41: Low Inductance Feed Point First Feed Conductive Cylinder
42: Low Inductance Feed Point Second Feed Conductive Cylinder
43: Low Inductance Feed Point Transition Conductor
44: Low Inductance Feed Point Opening
45: Low Inductance Feed Point Gap
46: Low Inductance Feed Point Gap First Inner Conductive Cylinder
47: Low Inductance Feed Point Gap Second Inner Conductive Cylinder
5*x*: Mounting Mast
50: Mounting Mast Section
51: Mounting Mast Upper Mounting Mast Member
52: Mounting Mast Lower Mounting Mast Member
54: Mounting Mast Top
6*x*: Mast Isolating Stub
60: Mast Isolating Stub Section
61: Mast Isolating Stub Side Conductor
62: Mast Isolating Stub Connecting Shorting Bar
63: Mast Isolating Stub Conductive Elbow
64: Mast Isolating Stub Conductive Tee
65: Mast Isolating Stub Free End
7*x*: Integral Coaxial Feed Line
71: Integral Coaxial Feed Line Bottom Facing Feed Point
73: Integral Coaxial Feed Line Internal Inner Conductor
74: Integral Coaxial Feed Line Internal Outer Conductor
1*xx*: Mechanical Features of Simulation Model
100: Traditional J Antenna in a Stand-alone, Isolated Configuration
101: Half-Wave Radiating Conductor
102: Quarter-Wave Parallel Transformer Inline Conductor
103: Quarter-Wave Parallel Transformer Side Conductor
104: Quarter-Wave Transformer Shunt Conductor
105: Conductive Mounting Mast
106: Simulated Ground (preferably with moderate soil characteristics)
107: Elongated Conductive Mounting Mast
108: Connection (or Contact) Point of Conductive Mounting Mast and Ground
109: Radial Conductor
110: Decoupling Conductive Stub
111: Decoupling Stub Conductive Shorting Bar
2*xx*: Electrical Features of Simulation Model
200: Collection of Radio Frequency Current Magnitude along Conductor Indicators
201: Half-Wave Radiating Conductor Open End High Voltage Point
202: Half-Wave Radiating Conductor Current Antinode
203: Half-Wave Radiating Conductor and Quarter-Wave Parallel Transformer Current Node and High Voltage Point
204: Quarter-Wave Parallel Transformer Inline Conductor Current
205: Quarter-Wave Parallel Transformer Side Conductor Current
206: Antenna Mounting Mast Conductor Current in Stand-alone, Isolated Application
207: Antenna Elongated Grounded Mounting Mast Conductor Current Antinode
209: Antenna Elongated Grounded Mounting Mast Conductor Current Antinode
211: Antenna Elongated Grounded Mounting Mast Conductor Current Antinode
213: Antenna Elongated Grounded Mounting Mast Conductor Current Antinode
215: Antenna Elongated Grounded Mounting Mast Conductor Ground Current
216: Radial Approach Upper Mast Current Node
217: Radial Approach Upper Mast Current
218: Radial Approach Radial Current
219: Radial Approach Mast Current
220: Radial Approach Mast Current Antinode
222: Radial Approach Mast Current Antinode

Figure 24:
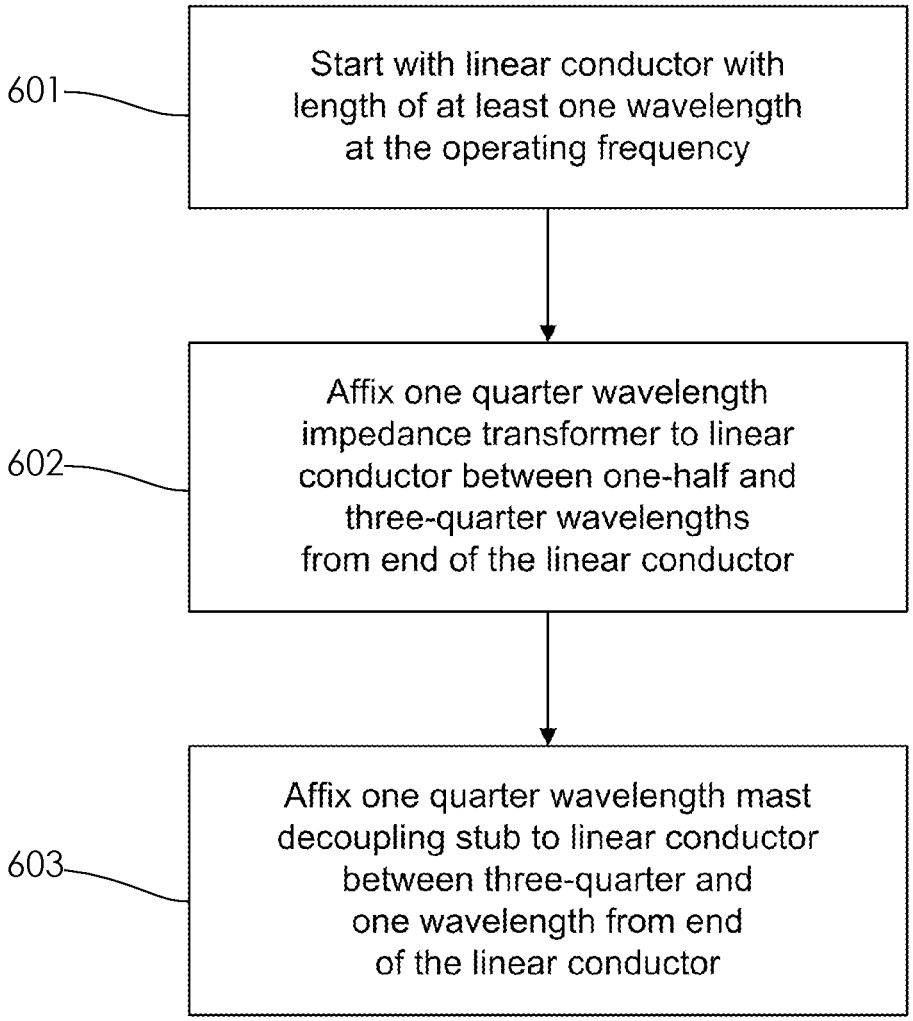
FIG. 24.
Figure 25:
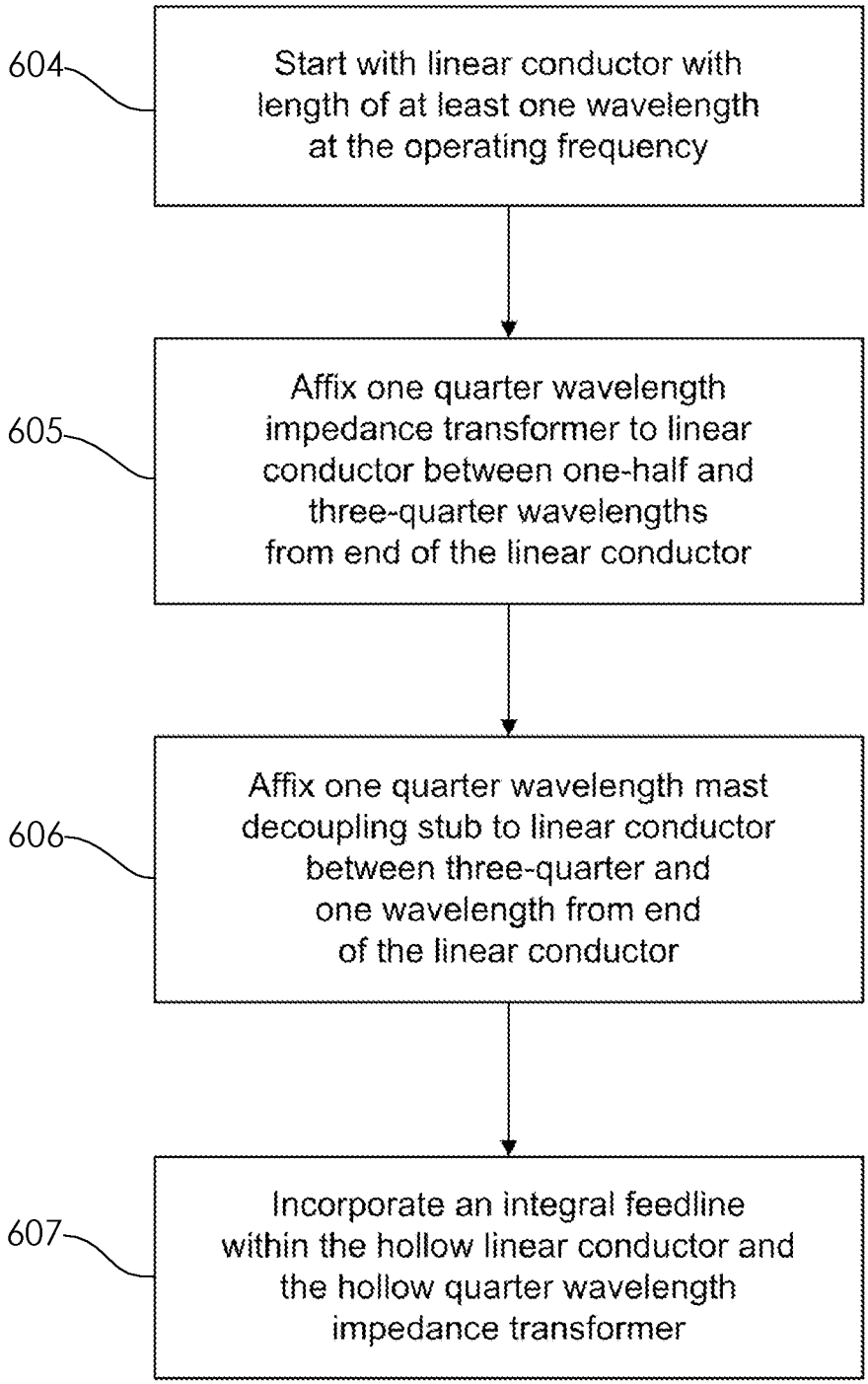
FIG. 25.

224: Radial Approach Mast Current Antinode
226: Mast Decoupling Stub Approach Upper Mast Current Node
227: Mast Decoupling Stub Approach Inline Upper Mast Current
228: Mast Decoupling Stub Approach Stub Current
230: Mast Decoupling Stub Approach Mast Current Antinode
232: Mast Decoupling Stub Approach Mast Current Antinode
234: Mast Decoupling Stub Approach Mast Current Antinode
3*xx*: Antenna Pattern (Simulated) Graphs
301: Maximum Gain—Stand-alone J Antenna above Ground, Low Elevation Peak Gain at Phi=180 (J side)
302: Second Highest Gain—Stand-alone J Antenna above Ground, Low Elevation Peak Gain at Phi=0
303: Grounded J Antenna above Ground, Low Elevation Gain at Phi=180 (J side)
304: Grounded J Antenna above Ground, Low Elevation Gain at Phi=0
305: Grounded J Antenna above Ground, Undesirable High Elevation Gain Lobe #1
306: Grounded J Antenna above Ground, Undesirable High Elevation Gain Lobe #2
307: Grounded J Antenna above Ground with Radial, Low Elevation Peak Gain at Phi=180 (J side)
308: Grounded J Antenna above Ground with Radial, Low Elevation Peak Gain at Phi=0
309: Present Invention, Low Elevation Peak Gain at Phi=180 (J side)
310: Present Invention, Low Elevation Peak Gain at Phi=0
4*xx*: 1 GHz Prototype Testing and Measurement
401: Prototype Half-Wave Radiating Conductor
402: Prototype Quarter-Wave Transformer Stub Side Conductor
403: Prototype Quarter-Wave Transformer Horizontal Conductor
404: Prototype Quarter-Wave Transformer Inline Conductor
405: Prototype Feed Point
406: Prototype Quarter-Wave Mast Isolating Stub Side Conductor
407: Prototype Mast Isolating Stub Horizontal Conductor
408: Prototype Conductive Mast
409: Prototype Mast Free Hanging End
410: Prototype Mast Length Variation Dimension Indicator
5*xx*: Graphs from Testing of 1 GHz Prototype
501: 50-Ohm Return Loss (Negative) Axis of the Graph in FIG. 21A
502: Frequency Axis of the Graph in FIG. 21A
503: Graph Plots of Return Loss (Negative) vs. Frequency from Approximately 8 cm to Approximately 30 cm in FIG. 21A
504: 50-Ohm Return Loss (Negative) Axis of the Graph in FIG. 21B
505: Frequency Axis of the Graph in FIG. 21B
506: Graph Plots of Return Loss (Negative) vs. Frequency from Approximately 8 cm to Approximately 30 cm in FIG. 21B
507: 50-Ohm VSWR Axis of the Graph in FIG. 22A
508: Frequency Axis of the Graph in FIG. 22A
509: Graph Plots of VSWR vs. Frequency from Approximately 8 cm to Approximately 30 cm in FIG. 22A
510: 50-Ohm VSWR Axis of the Graph in FIG. 22B
511: Frequency Axis of the Graph in FIG. 22B
512: Graph Plots of VSWR vs. Frequency from Approximately 8 cm to Approximately 30 cm in FIG. 22B
513: Antenna Gain Radial Axis of the Graph in FIG. 23A
514: Theta Polar Axis of the Graph in FIG. 23A
515: Graph Plots of Antenna Gain vs. Theta from Approximately 8 cm to Approximately 30 cm in FIG. 23A
516: Antenna Gain Radial Axis of the Graph in FIG. 23B
517: Theta Polar Axis of the Graph in FIG. 23B
518: Graph Plots of Antenna Gain vs. Theta from Approximately 8 cm to Approximately 30 cm in FIG. 23B
6*xx*: Steps in Process
601: Step One of the Process Flow Chart in FIG. 24
602: Step Two of the Process Flow Chart in FIG. 24
603: Step Three of the Process Flow Chart in FIG. 24
604: Step One of the Process Flow Chart in FIG. 25
605: Step Two of the Process Flow Chart in FIG. 25
606: Step Three of the Process Flow Chart in FIG. 25
607: Step Four of the Process Flow Chart in FIG. 25

It is to be appreciated that the above description and the drawings are intended to be used to interpret the claims. Parts of the description may set forth one or more, but not all, preferred embodiments of the present invention as contemplated by the inventor and, thus, are not intended to limit the present invention nor the appended claims.

Moreover, the foregoing description of the invention will so fully reveal the general nature of the invention that others can, by applying knowledge within the skill of the relevant art(s), readily modify and/or adapt the described embodiments for various applications, without undue experimentation and without departing from the general concept of the invention. Therefore, such modifications and adaptations are intended to be within the meaning and range of equivalents of the disclosed embodiments. It is to be understood that the phraseology and terminology herein are for the purpose of description and not of limitation, such that the phraseology and terminology are meant in their broadest, most reasonable sense, unless otherwise indicated. In addition, any headings in the specification are for convenience only and are not limiting.

What is claimed is:

1. A mast mountable antenna having a continuous electrically conductive structure comprising:

a. a radiating conductor section, comprising a conductor having a free end and an affixed end;

b. an impedance transformer section, comprising a side conductor connected to an inline conductor by at least one shorting bar;

c. a feed point within the impedance transformer section, comprising first and second feed point conductors separated by a feed point gap;

d. a mounting mast section, comprising an upper mounting mast member and a lower mounting mast member;

e. a mast isolating stub section, comprising at least one conductor connected to the upper mounting mast member of the mounting mast section by at least one shorting bar; and f. a feed line within the impedance transformer section and mounting mast section;

wherein the radiating conductor section is connected at the affixed end to the inline conductor of the impedance transformer section, which is connected to the upper mounting mast member of the mounting mast section; and wherein the first feed point conductor is connected to the inline conductor of the impedance transformer section at an inline feed tap tee and the second feed point conductor is connected to the side conductor of the impedance transformer section at a side feed tap tee and the two feed point conductors protrude inward from their respective connections toward each other.

2. The mast mountable antenna of claim 1, wherein the feed line is an internal coaxial cable.

3. The mast mountable antenna of claim 2, wherein the feed line comprises the inner wall of the mast mountable antenna structure and a concentric, conductive internal cylinder.

4. The mast mountable antenna of claim 3, wherein the second feed point conductor is connected to a transition conductor inside the opening in the feed point gap, wherein the opening is in the first feed point conductor.

5. A method of making a conductive mast mountable mono-frequency antenna, comprising:

a. Providing a linear conductor of at least one wavelength at the desired operating frequency;

b. Affixing a one-quarter wavelength impedance transformer to the linear conductor between one-half and three-quarter wavelengths from the end of the linear conductor;

c. Affixing a one-quarter wavelength mast isolating stub to the linear conductor between three-quarter wavelengths and one wavelength from the end of the linear conductor; and d. Incorporating a feed line external to the antenna.

6. A method of making a conductive mast mountable mono-frequency antenna, comprising:

a. Providing a linear conductor of at least one wavelength at the desired operating frequency;

b. Affixing a one-quarter wavelength impedance transformer to the linear conductor between one-half and three-quarter wavelengths from the end of the linear conductor;

c. Affixing a one-quarter wavelength mast isolating stub to the linear conductor between three-quarter wavelengths and one wavelength from the end of the linear conductor; and d. Integrating a feed line internally in the antenna structure.

7. The method of claim 6, wherein the feed line is a coaxial feed line.

* * * * *